US011731434B2

(12) United States Patent
Takei

(10) Patent No.: US 11,731,434 B2
(45) Date of Patent: Aug. 22, 2023

(54) RECORDING APPARATUS, METHOD FOR CONTROLLING RECORDING APPARATUS, AND NON-TRANSITORY COMPUTER-READABLE STORAGE MEDIUM STORING PROGRAM FOR CONTROLLING RECORDING APPARATUS

(71) Applicant: Seiko Epson Corporation, Tokyo (JP)

(72) Inventor: Atsushi Takei, Chino (JP)

(73) Assignee: Seiko Epson Corporation, Tokyo (JP)

( * ) Notice: Subject to any disclaimer, the term of this patent is extended or adjusted under 35 U.S.C. 154(b) by 116 days.

(21) Appl. No.: 17/498,434

(22) Filed: Oct. 11, 2021

(65) Prior Publication Data

US 2022/0111661 A1 Apr. 14, 2022

(30) Foreign Application Priority Data

Oct. 14, 2020 (JP) ..... 2020-173224

(51) Int. Cl.

| | |
|---|---|
| ***B41J 11/00*** | (2006.01) |
| ***B41J 13/00*** | (2006.01) |
| ***B65H 29/24*** | (2006.01) |

(52) U.S. Cl.

CPC ..... *B41J 11/0025* (2013.01); *B41J 11/0005* (2013.01); *B41J 13/0009* (2013.01); *B65H 29/245* (2013.01)

(58) Field of Classification Search

CPC ..... B41J 11/0025; B41J 11/0005; B41J 13/0009; B65H 29/245

See application file for complete search history.

(56) References Cited

U.S. PATENT DOCUMENTS

2011/0242184 A1* 10/2011 Kachi ..... B41J 2/04535 347/17
2016/0089912 A1 3/2016 Chiba et al.
2021/0031510 A1* 2/2021 Asamoto ..... B41J 11/002

FOREIGN PATENT DOCUMENTS

JP 2016-069187 5/2016
JP 2020104425 A * 7/2020 ..... B41J 11/002

* cited by examiner

*Primary Examiner* — Sharon Polk
(74) *Attorney, Agent, or Firm* — Workman Nydegger

(57) ABSTRACT

A printer includes a record section, a discharge section, a mount section, a movable rib, a move section, and a control section. The record section records on a sheet by ejecting an ink to the sheet. The discharge section discharges the sheet. The mount section has a mount surface on which the sheet discharged is mounted. A movable rib is configured to protrude from the mount surface and supports the sheet. The dimension of the movable rib in an A-direction is larger than the dimension thereof in a Y-direction. The move section moves the movable rib in a C-direction. The control section controls, based on temperature and humidity information, movement of the movable rib made by the move section.

12 Claims, 14 Drawing Sheets

FIG. 7

DT

| ENVIRONMENT | IMAGE DENSITY | | |
|---|---|---|---|
| | LOW DENSITY | INTERMEDIATE DENSITY | HIGH DENSITY |
| REFERENCE ENVIRONMENT | OFF | OFF | ON |
| ENVIRONMENT WITH HIGH TEMPERATURE AND LOW HUMIDITY | OFF | OFF | ON |
| ENVIRONMENT WITH HIGH TEMPERATURE AND HIGH HUMIDITY | OFF | OFF | ON |
| ENVIRONMENT WITH LOW TEMPERATURE AND LOW HUMIDITY | OFF | ON | ON |
| ENVIRONMENT WITH LOW TEMPERATURE AND HIGH HUMIDITY | OFF | ON | ON |

RECORDING APPARATUS, METHOD FOR CONTROLLING RECORDING APPARATUS, AND NON-TRANSITORY COMPUTER-READABLE STORAGE MEDIUM STORING PROGRAM FOR CONTROLLING RECORDING APPARATUS

The present application is based on, and claims priority from JP Application Serial Number 2020-173224, filed Oct. 14, 2020, the disclosure of which is hereby incorporated by reference herein in its entirety.

BACKGROUND

1. Technical Field

The present disclosure relates to a recording apparatus, a method for controlling the recording apparatus, and a non-transitory computer-readable storage medium storing a program for controlling the recording apparatus.

2. Related Art

A printer in JP-A-2016-69187 includes a record section, a medium transport route, a mount tray on which a sheet discharged is mounted, a protruding rib configured to protrude from a mount surface of the mount tray, and a protrusion mechanism that causes the protruding rib to protrude from the mount surface. The height of the protruding rib is set based on the sheet size, including thickness, and the coverage rate.

If the environment that a recording apparatus is in changes, the magnitude of sheet curl may change even under the same conditions of sheet size and coverage rate. Thus, sheet curl may not be mitigated satisfactorily by, as the printer of JP-A-2016-69187 does, changing of the height of the protruding rib based only on the sheet size and the coverage rate. Also, some environments may not need mitigation of sheet curl, and if the protruding rib is caused to protrude based on the sheet size and the coverage rate in such environments, the sheet may be misaligned.

SUMMARY

To solve the above problem, a recording apparatus according to an aspect of the present disclosure includes a record section that records on a medium by ejecting a liquid to the medium; a discharge section that discharges the medium recorded by the record section; a mount section that has a mount surface on which the medium discharged by the discharge section is mounted; a protrusion that is configured to support the medium and protrude from the mount surface in a stacking direction in which the medium is stacked, a first dimension of the protrusion in a discharge direction in which the medium is discharged being larger than a second dimension of the protrusion in a width direction intersecting with the discharge direction; a move section that moves the protrusion in the stacking direction; and a control section that controls, based on at least one of information on temperature and information on humidity, movement of the protrusion made by the move section.

To solve the above problem, according to an aspect of the present disclosure, a method for controlling a recording apparatus including a record section that records on a medium by ejecting a liquid to the medium, a discharge section that discharges the medium recorded by the record section, a mount section that is has a mount surface on which the medium discharged by the discharge section is mounted, a protrusion that is configured to support the medium and protrude from the mount surface in a stacking direction in which the medium is stacked, a first dimension of the protrusion a discharge direction in which the medium is discharged being larger than a second dimension of the protrusion in a width direction intersecting with the discharge direction, a move section that moves the protrusion in the stacking direction, and a control section that controls movement of the protrusion made by the move section, the method including: acquiring at least one of information on temperature and information on humidity and changing, based on at least one of the information on the temperature and the information on the humidity, an amount of protrusion of the protrusion from the mount surface.

To solve the above problem, according to an aspect of the present disclosure, a non-transitory computer-readable storage medium storing a program for controlling a recording apparatus including a record section that records on a medium by ejecting a liquid to the medium, a discharge section that discharges the medium recorded by the record section, a mount section that has a mount surface on which the medium discharged by the discharge section is mounted, a protrusion that is configured to support the medium and protrude from the mount surface in a stacking direction in which the medium is stacked, a first dimension of the protrusion in a discharge direction in which the medium is discharged being larger than a dimension of the protrusion in a width direction intersecting with the discharge direction, a move section that moves the protrusion in the stacking direction, and a control section that controls movement of the protrusion made by the move section, the program causing a computer to execute: acquiring at least one of information on temperature and information on humidity and changing, based on at least one of the information on the temperature and the information on the humidity, an amount of protrusion of the protrusion from the mount surface.

BRIEF DESCRIPTION OF THE DRAWINGS

FIG. 7 is a data table set in the printer according Embodiment 1, the data table indicating "ON" and "OFF" of the ascending operation of a movable rib for each combination of an environment condition and an image density condition.

DESCRIPTION OF EXEMPLARY EMBODIMENTS

Figure 1:
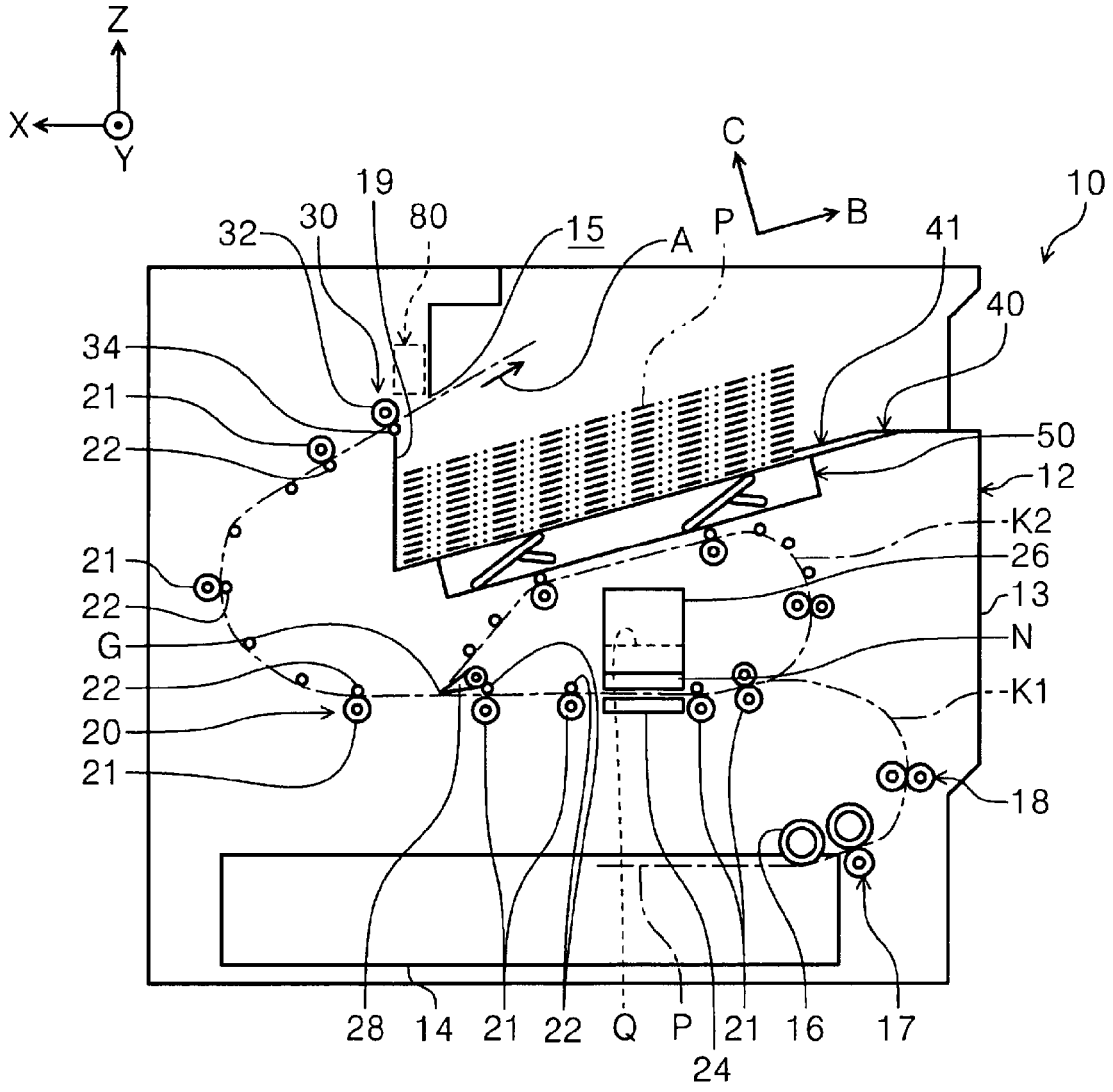
FIG. 1 is an overall view of a printer according to Embodiment 1.

Hereinbelow, an outline of the present disclosure is described.

According to a first aspect, a recording apparatus includes a record section that records on a medium by ejecting a liquid to the medium; a discharge section that discharges the medium recorded by the record section; a mount section that has a mount surface on which the medium discharged by the discharge section is mounted; a protrusion that is configured to support the medium and protrude from the mount surface in a stacking direction in which the medium is stacked, a first dimension of the protrusion in a discharge direction in which the medium is discharged being larger than a second dimension of the protrusion in a width direction intersecting with the discharge direction; a move section that moves the protrusion in the stacking direction; and a control section that controls, based on at least one of information on temperature and information on humidity, movement of the protrusion made by the move section.

According to this aspect, when the medium is likely to curl determining from at least one of a temperature condition and a humidity condition, the control section causes the move section to move so that the protrusion protrudes from the mount surface in the stacking direction. The protrusion thus protruding supports the medium discharged from the discharge section. This causes portions of the medium that are not supported by the protrusion to descend toward the mount surface due to their self-weight. The medium is thereby forced to curl in the opposite direction from the direction in which the medium originally curls, and thus, the curl in the medium can be mitigated.

Conversely, when the medium is unlikely to curl determining from at least one of a temperature condition and a humidity condition, the control section causes or does not cause the move section to move so that the protrusion does not protrude from the mount surface in the stacking direction. In this state, the mount section supports one edge portion and an opposite edge portion, in the width direction, of the medium discharged from the discharge section. This helps prevent the medium that is not curled so much from being displaced in one direction or the opposite direction along the width direction by coming into contact with the protrusion. Thus, the alignment of the medium can be improved.

According to a second aspect, the recording apparatus of the first aspect is such that when the temperature is a first temperature and the humidity is a first humidity, the control section causes the protrusion to position at a first position in the stacking direction, and when the temperature is a second temperature that is higher than the first temperature and the humidity is a second humidity that is higher than the first humidity, the control section causes the protrusion to position at a second position at which the protrusion is closer to the mount surface than at the first position in the stacking direction.

The second temperature is higher than the first temperature, and the second humidity is higher than the first humidity. When the temperature and humidity in the installation environment become high, the amount of moisture penetrating into the medium increases, making it unlikely for the medium to curl.

According to the above aspect, when the temperature and humidity are the second temperature and the second humidity at which the medium is unlikely to curl, the protrusion is brought to the second position. In other words, the protrusion is reduced in height. This helps prevent the protrusion from protruding wastefully and coming into contact with the medium when the medium is unlikely to curl and therefore prevent the medium from being misaligned in the width direction by coming into contact with the protrusion.

According to a third aspect, the recording apparatus of the first or second aspect is such that an amount of liquid ejected from the record section is configured to be changed, and the control section controls, based on the information on the temperature, the information on the humidity, and information on the amount of liquid ejected, movement of the protrusion made by the move section.

When the amount of liquid ejected increases, the amount of moisture penetrating into the medium increases as well. Thus, the medium is unlikely to curl. Conversely, when the amount of liquid ejected decreases, there is a difference in the amount of moisture between a portion of the medium having the liquid attached thereto and a portion of the medium not having the liquid attached thereto. Thus, the medium is likely to curl.

According to the above aspect, the amount of protrusion of the protrusion can be set based not only on the temperature information and the humidity information, but also on the information on the amount of liquid ejected. Thus, the amount of protrusion of the protrusion can be determined accurately based on whether the medium is likely to curl.

According to a fourth aspect, the recording apparatus of any one of the first to third aspects is such that the mount surface has a first mount surface that has an opening through which the protrusion is configured to pass and second mount surfaces that locate on one side and an opposite side relative to the first mount surface in the width direction and slant toward the first mount surface.

According to this aspect, the first mount surface and the second mount surfaces form a valley shape when seen in the discharge direction. Then, when the protrusion does not protrude, the medium is mounted while forming a shape conforming to the first mount surface and the second mount surfaces due to its self-weight. If the mounted medium tries to be displaced in the width direction, this valley shape restricts such displacement of the medium in the width direction, which helps prevent misalignment of the mounted medium.

According to a fifth aspect, the recording apparatus of the fourth aspect is such that the mount surface further has third mount surfaces that locate on outer sides relative to the first mount surface and the second mount surfaces in the width direction, and the third mount surfaces extend along directions intersecting with directions in which the second mount surfaces are slanted.

According to the above aspect, when the medium seems to be displaced in the width direction relative to the first mount surface and the second mount surfaces with the protrusion not protruding, the medium comes into contact with the third mount surfaces and consequently a friction force acts on the medium. This friction force helps prevent displacement of the medium in the width direction.

According to a sixth aspect, the recording apparatus of any one of the first to fifth aspects further includes an air blow section that blows air against one portion of the mount surface and an opposite portion of the mount surface relative to the protrusion in the width direction.

According to this aspect, irrespective of whether the protrusion protrudes, not only the self-weight but also the air pressure from the air blow section acts on the medium in contact with the protrusion. This makes it easier to reduce the curl in the medium.

According to a seventh aspect, the recording apparatus of the sixth aspect is such that, when the protrusion does not protrude from the mount surface, the control section employs a first air blow amount for the air blow section and when the protrusion protrudes from the mount surface, the control section employs a second air blow amount for the air blow section, the first air blow amount being less than the second air blow amount.

According to this aspect, when the protrusion does not protrude from the mount surface, air of the first air blow amount which is less than the second air blow amount is blown to decrease the air pressure acting on the medium. This decreases the load acting on the medium when the medium moves from the discharge section to the mount surface and helps prevent the air blown by the air blow section from restricting the movement of the medium.

According to an eighth aspect, the recording apparatus of any one of the first to seventh aspects is such that an amount of protrusion of the protrusion from the mount surface is configured to changed in a plurality of stages.

According to this aspect, the height of the protrusion can be changed in three or more stages according to the state of curl formed in the medium. This helps prevent the protrusion from protruding too much from the mount surface and allows more media to be stacked.

According to a ninth aspect, the recording apparatus of any one of the first to eighth aspects further includes: a post-processing section that performs a post-processing on the medium recorded by the record section; and a switch section that switches a transport route of the medium having the information recorded thereon by the record section to one of a first route directed to the discharge section and a second route directed to the post-processing section, in which the control section controls, based on at least one of the information on the temperature and the information on the humidity, switching operation of the switch section, and when the transport route of the medium is the second route, the control section controls the move section so that the protrusion does not protrude from the mount surface.

According to this aspect, a second route along which the medium having information recorded thereon is transported to be subjected to the post-processing in the post-processing section is longer than a first route along which the media having information recorded thereon is transported to be discharged from the discharge section. Thus, the transport route of the medium can be set longer. Thus, when the second route is selected, the medium is more likely to dry, and curl in the media can be mitigated further. Also, when the transport route of the medium is the second route, the protrusion does not protrude from the mount surface. This helps prevent the protrusion from making it hard to take out the medium mounted on the mount surface.

According to a tenth aspect, a method for controlling a recording apparatus including a record section that records on a medium by ejecting a liquid to the medium, a discharge section that discharges the medium recorded by the record section, a mount section that has a mount surface on which the medium discharged by the discharge section is mounted, a protrusion that is configured to support the medium and protrude from the mount surface in a stacking direction in which the medium is stacked, a first dimension of the protrusion in a discharge direction in which the medium is discharged being larger than a dimension of the protrusion in a width direction intersecting with the discharge direction, a move section that moves the protrusion in the stacking direction, and a control section that controls movement of the protrusion made by the move section, the method including: acquiring at least one of information on temperature and information on humidity and changing, based on at least one of the information on the temperature and the information on the humidity, an amount of protrusion of the protrusion from the mount surface.

This aspect can offer operation and advantageous effects similar to those offered by the recording apparatus according to the first aspect.

According to an 11th aspect, a non-transitory computer-readable storage medium storing a program for controlling a recording apparatus including a record section that records on a medium by ejecting a liquid to the medium, a discharge section that discharges the medium recorded by the record section, a mount section that has a mount surface on which the medium discharged by the discharge section is mounted, a protrusion that is configured to support the medium and protrude from the mount surface in a stacking direction in which the medium is stacked, a first dimension of the protrusion in a discharge direction in which the medium is discharged being larger than a second dimension of the protrusion in a width direction intersecting with the discharge direction, a move section that moves the protrusion in the stacking direction, and a control section that controls movement of the protrusion made by the move section, the program causing a computer to execute: acquiring at least one of information on temperature and information on humidity and changing, based on at least one of the information on the temperature and the information on the humidity, an amount of protrusion of the protrusion from the mount surface.

This aspect can offer operation and advantageous effects similar to those offered by the recording apparatus according to the first aspect.

Embodiment 1

As an example of a recording apparatus, an example of a method for controlling the recording apparatus, and an example of a non-transitory computer-readable storage medium storing a program for controlling the recording apparatus according to the present disclosure, the following specifically describes a printer 10 of Embodiment 1, a method for controlling the printer 10, and a program PR for controlling the printer 10.

As illustrated in FIG. 1, the printer 10 is configured as an ink jet apparatus that records information on a sheet P, which is an example of a medium, by ejecting an ink Q, which is an example of a liquid, to the sheet P. Note that the X-Y-Z coordinate system illustrated in each drawing is a Cartesian coordinate system.

The X-direction is the apparatus's width direction as seen from an operator of the printer 10 and is horizontal. A direction along the X-direction directed toward the left is denoted as a +X-direction, and a direction along the X-direction directed toward the right is denoted as a −X-direction.

The Y-direction is an example of the width direction of a movable rib 50 to be described later and the apparatus's depth direction which intersect with the transport direction of the sheet P, and is horizontal. The Y-direction is also the width direction of the sheet P. Also, the Y-direction intersects with an A-direction, a B-direction, and a C-direction to be described later. A direction along the Y-direction directed to the near side is denoted as a +Y-direction, and a direction along the Y-direction directed to the far side is denoted as a −Y-direction. Note that the Y-direction is an example of a direction that intersects with a D-direction to be described later.

The Z-direction is the apparatus's height direction, and is, by way of example, vertical. A direction along the Z-direction directed upward is denoted as a +Z-direction, and a direction along the Z-direction directed downward is denoted as a −Z-direction.

The A-direction is an example of the discharge direction of the sheet P discharged from a discharge section 30 to be described later. Note that the arrow A denoting the A direction in FIG. 1 illustrates a hypothetical direction in which the sheet P would take when moving straight from the discharge section 30 irrespective of factors such as the self-weight of the sheet P.

The B-direction is an example of a direction in which a mount surface 41 to be described later extends when seen in the Y-direction. Note that a direction along the B-direction directed away from a vertical wall 19 to be described later is denoted as a +B-direction, and a direction along the B-direction directed toward the vertical wall 19 is denoted as a −B-direction.

The C-direction is an example of the stacking direction in which the sheets P are stacked on the mount surface 41. A direction along the C-direction in which the number of sheets stacked increases is denoted as a +C-direction, and a direction along the C-direction in which the number of sheets stacked decreases is denoted as a −C-direction. Note that in the present embodiment, the stacking direction is, by way of example, a direction not along the Z-direction but along a direction orthogonal to the B-direction.

The D-direction (FIG. 5) is an example of the slanting directions of second mount surfaces 44, 45 (FIG. 5) to be described later. Note that the second mount surface 44 and the second mount surface 45 are symmetrical about an imaginary plane (not illustrated) extending in the X-direction and passing through the Y-direction center of the printer 10. Thus, a direction in which the second mount surface 44 is slanted is denoted as a −D-direction, and a direction in which the second mount surface 45 is slanted is denoted as a +D-direction to make a distinction.

The printer 10 has an apparatus main body 12. The apparatus main body 12 includes a plurality of frames (not illustrated) and a housing 13 defining the outer shape of the printer 10. A mount section 40 is formed on the +Z-direction side relative to the center of the apparatus main body 12 in the Z-direction, so that a sheet P having information recorded thereon and then discharged is mounted on the mount section 40. The apparatus main body 12 is also provided with a sheet cassette 14.

In the sheet cassette 14, at least one sheet P is housed. The sheet P housed in the sheet cassette 14 is transported along a transport route K1 by a pickup roller 16 and transport roller pairs 17, 18.

A discharge opening 15 is formed in the apparatus main body 12, open to the mount section 40. The discharge opening 15 is, by way of example, rectangular long in the Y-direction when seen in the X-direction. The sheet P passes through the discharge opening 15 and arrives at the mount section 40.

By way of example, the transport route K1 is formed inside the apparatus main body 12, extending from the sheet cassette 14 to the mount section 40 in a letter S shape. On the transport route K1, a transport section 20 is provided to transport the sheet P along the transport route K1.

The transport section 20 has a plurality of rollers including a plurality of rollers 21 and a plurality of rollers 22. The rollers 21 and the rollers 22 are arranged with their axes extending in the Y-direction and provided to be rotatable about their axes. Some of the rollers 21 and the rollers 22 are not denoted by reference numerals in FIG. 1. The rollers 21 are larger in diameter than the rollers 22.

At given locations along the transport route K1, a support platform 24, a record section 26, and the discharge section 30 to be described later are disposed.

The support platform 24 is disposed on the −Z-direction side relative to the transport route K1. The support platform 24 supports the transported sheet P from the −Z-direction side.

The record section 26 is configured as, by way of example, a line head and records information on the sheet P by ejecting an ink Q to the sheet P. The record section 26 is disposed on the +Z-direction side relative to the transport route K1 and faces the support platform 24 in the Z-direction. Specifically, the record section 26 includes a tank (not illustrated) that houses the ink Q and a nozzle section N. The nozzle section N includes a plurality of nozzles (not illustrated) from which to eject the ink Q. The nozzle section N covers the entire range of the sheet P in the Y-direction.

The record section 26 records information such as an image on a sheet P by ejecting the ink Q from the nozzle section N toward the sheet P. The method for ejecting the ink Q from the nozzle section N may be the piezoelectric method, which causes ink chambers to expand or contract by application of voltage to piezoelectric elements, or the thermal method, which produces air bubbles inside the nozzles by using heat generation elements and ejects an ink Q from the nozzles by the action of the air bubbles. By way of example, the present embodiment employs the piezoelectric method.

The record section 26 can change the amount of ink ejected, which is an example of the amount of liquid ejected, by changing how much the piezoelectric elements deform.

Inside the apparatus main body 12, by way of example, an inversion route K2 is formed, surrounding the record section 26 together with the transport route K1. The inversion route K2 flips the sheet P over from the front to the back. The end of the inversion route K2 in the −X-direction is located on the −X-direction side relative to the record section 26 and merges with the transport route K1. The end of the inversion route K2 in the +X-direction is located on the +X-direction side relative to the record section 26 and merges with the transport route K1.

A flapper 28 is provided in the vicinity of a position G where the end of the inversion route K2 in the +X-direction merges with the transport route K1.

The flapper 28 can switch between a position to permit the sheet P to move along the transport route K1 and to restrict the sheet P from entering the inversion route K2, and a position to guide the sheet P to the inversion route K2 from a point on the transport route K1 which is on the +X-direction side relative to the position G. The flapper 28 is switched by a control section 70 (FIG. 2) to be described later.

Figure 2:
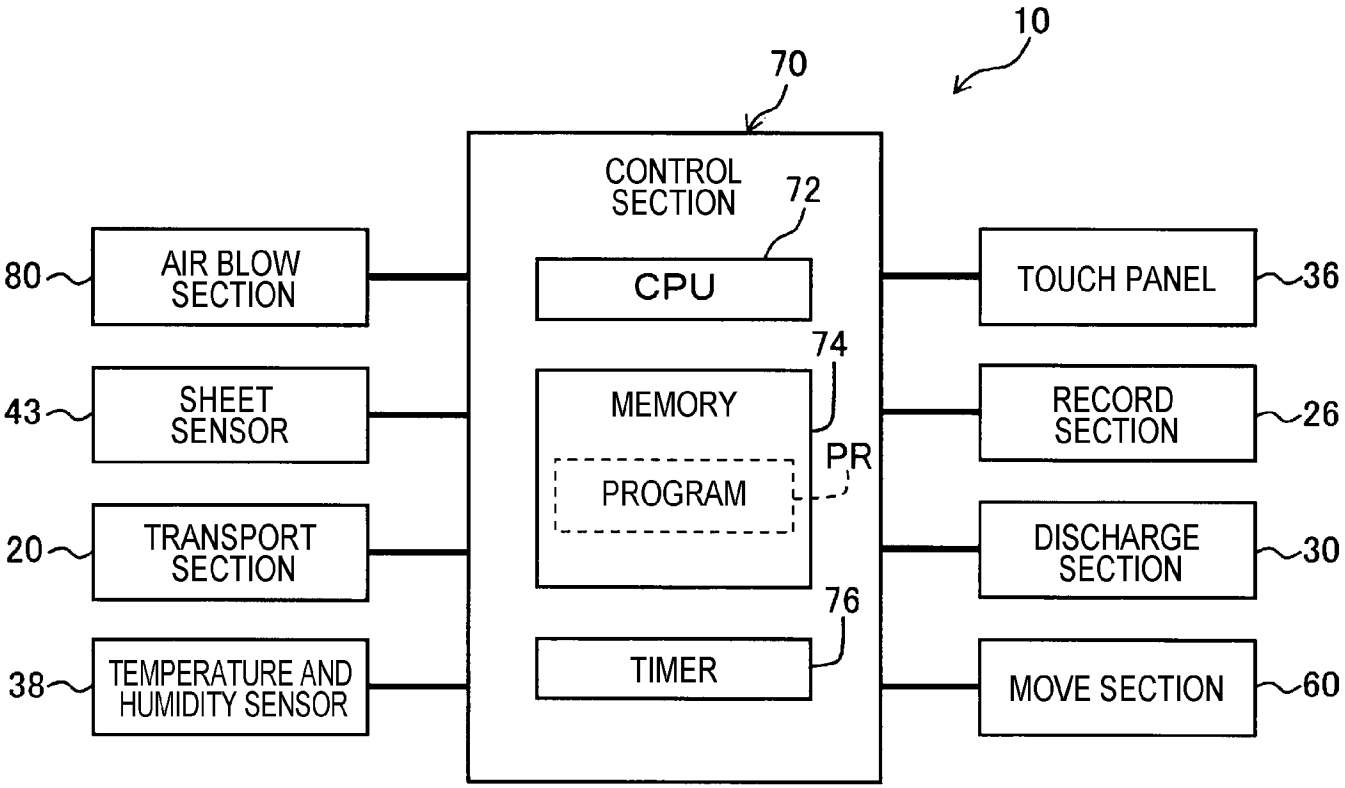
FIG. 2 is a block diagram of a main part of the printer according to Embodiment 1.

As illustrated in FIG. 2, the printer 10 includes the transport section 20, the record section 26, the discharge section 30, the mount section 40 (FIG. 1), the movable rib 50 (FIG. 1), a move section 60, the control section 70, and an air blow section 80. The printer 10 further includes a touch panel 36, a temperature and humidity sensor 38, and a sheet sensor 43.

As illustrated in FIG. 1, the discharge section 30 discharges a sheet P having information recorded thereon by the record section 26 to the mount section 40. Specifically, the discharge section 30 is formed by, by way of example, a drive roller 32, a driven roller 34, a motor (not illustrated), and gears (not illustrated). The drive roller 32 and the driven roller 34 are located on the +X-direction side relative to the discharge opening 15. The drive roller 32 and the driven roller 34 are rotatable about their axes extending in the Y-direction, and by rotating, nip the sheet P and discharge the sheet P in the A-direction from the discharge opening 15 to the mount section 40.

Figure 3:
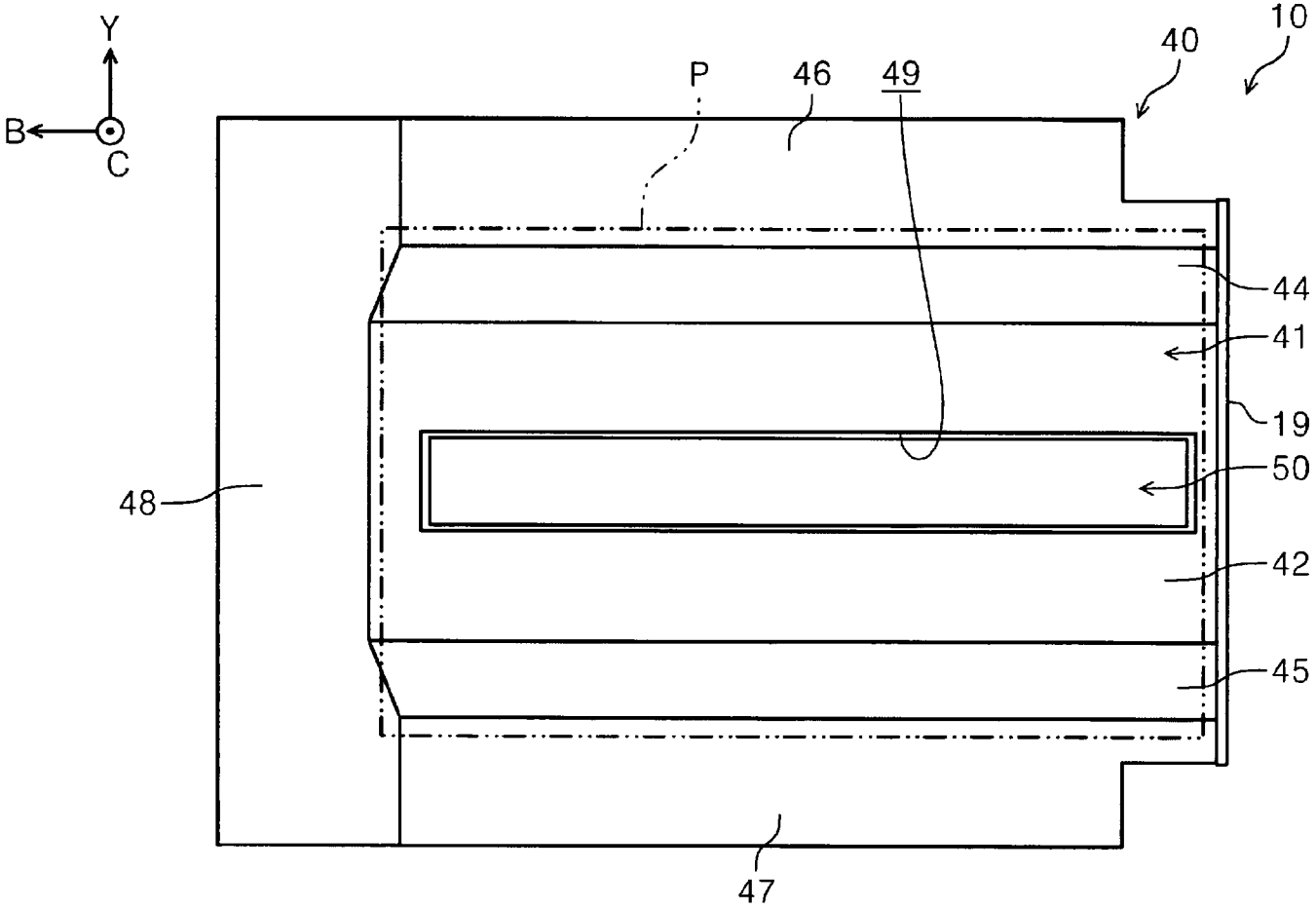
FIG. 3 is a plan view of a mount section according to Embodiment 1.

As illustrated in FIG. 3, the mount section 40 has the mount surface 41 on which a sheet P discharged by the discharge section 30 (FIG. 1) is mounted. Note that the vertical wall 19 is provided at an edge portion of the mount surface 41 in the +X-direction, extending upright from the mount surface 41 in the +Z-direction.

The vertical wall 19 is substantially a rectangle whose dimension in the Y-direction is longer than its dimension in the Z-direction when seen from the −X-direction side relative to the printer 10. The vertical wall 19 is formed in a plate shape having a predetermined thickness in the X-direction. The vertical wall 19 is disposed on the −Z-direction side relative to the discharge section 30. The Y-direction width of the vertical wall 19 is larger than the maximum Y-direction width of the sheet P usable for the printer 10. The Z-direction height of the vertical wall 19 is larger than the maximum stacking height of sheets P mountable on the mount section 40.

Figure 4:
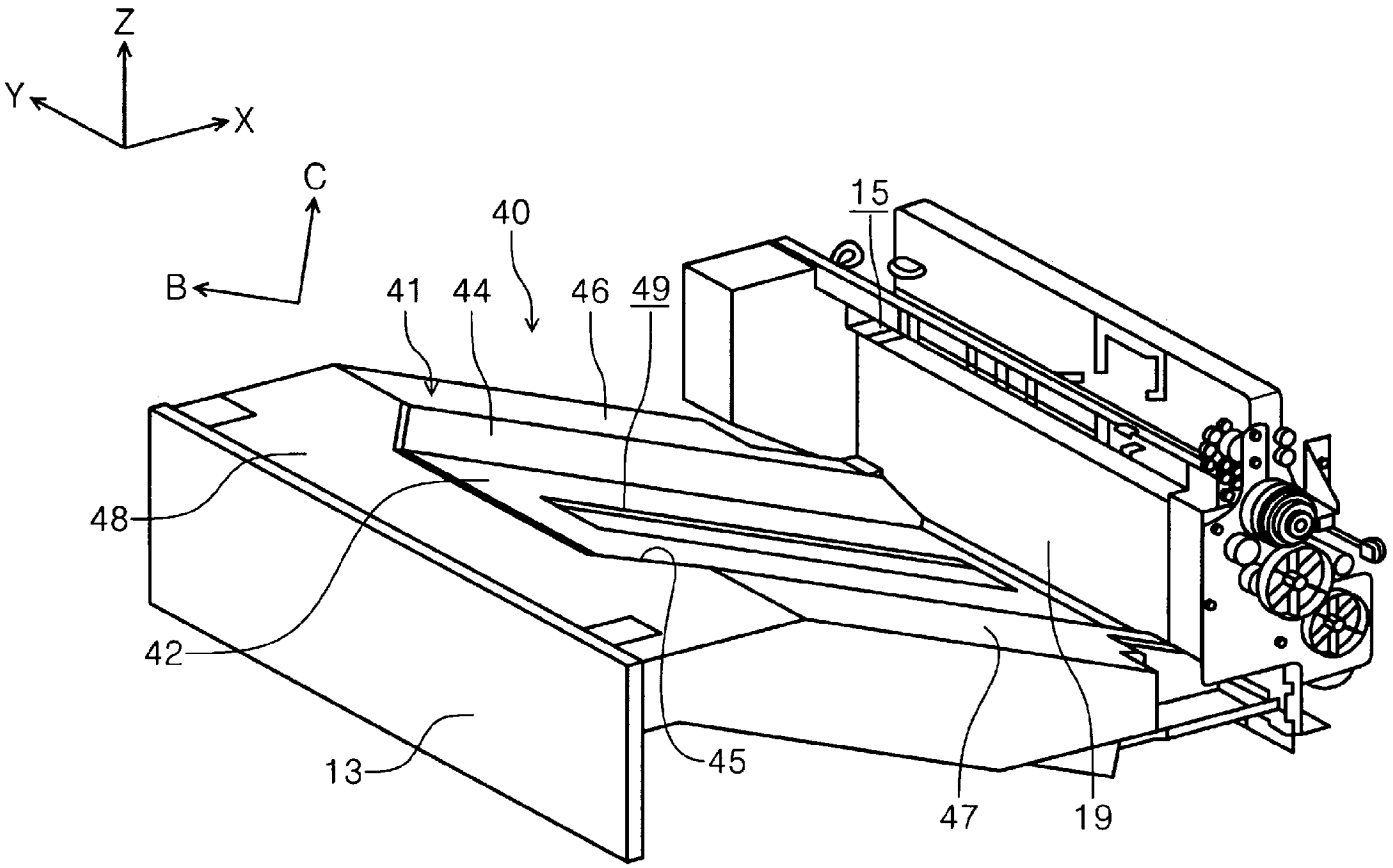
FIG. 4 is a perspective view of the mount section and a discharge section according to Embodiment 1.
Figure 5:
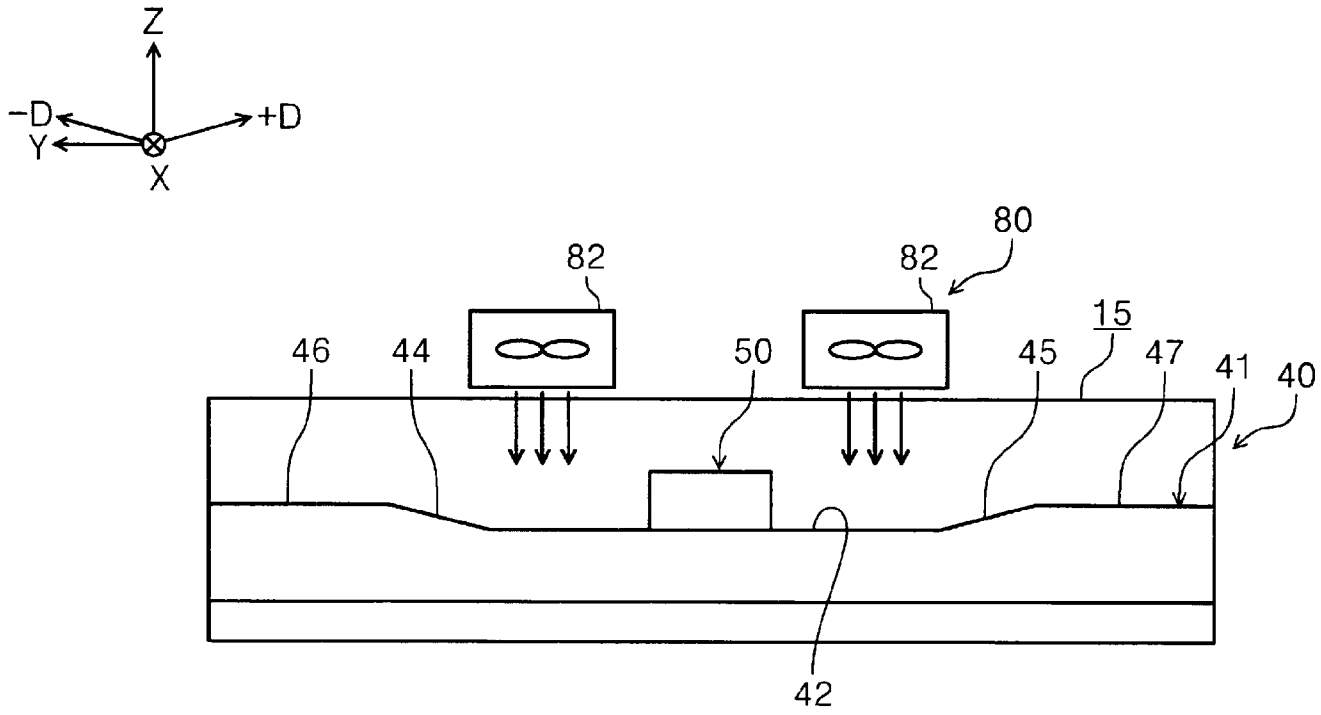
FIG. 5 is a schematic view of the mount section and an air blow section according to Embodiment 1, seen in a discharge direction.

As illustrated in FIGS. 3, 4, and 5, the mount surface 41 has, by way of example, a first mount surface 42, the second mount surfaces 44, 45, third mount surfaces 46, 47, and a fourth mount surface 48.

The first mount surface 42 forms a Y-direction center portion of the mount surface 41. The first mount surface 42 is a gradually rising surface, rising in the +Z-direction toward the +A-direction side. In other words, the first mount surface 42 is a planar surface extending along the B-Y plane. Further, the first mount surface 42 is formed in a rectangular shape whose dimension in the B-direction is longer than its dimension in the Y-direction, when seen in the C-direction. The first mount surface 42 has a through-hole 49, which is an example of an opening portion, formed in a Y-direction center portion of the first mount surface 42.

The through-hole 49 is, by way of example, formed in a rectangular shape whose dimension in the B-direction is longer than its dimension in the Y-direction. The through-hole 49 is sized such that the movable rib 50 to be described later can pass therethrough. This allows the movable rib 50 to move in the C-direction through the through-hole 49.

The second mount surfaces 44, 45 are respectively located on one side and on the other side relative to the first mount surface 42 in the Y-direction.

The second mount surface 44 is a surface that is continuous with the first mount surface 42 and located on the +Y-direction side relative to the first mount surface 42. The length of the second mount surface 44 in the B-direction becomes shorter toward the +Y-direction side. The second mount surface 44 is slanted, descending in the −C-direction toward the −Y-direction side. In other words, the second mount surface 44 is slanted toward the first mount surface 42.

The second mount surface 45 is a surface that is continuous with the first mount surface 42 and located on the −Y-direction side relative to the first mount surface 42. The length of the second mount surface 45 in the B-direction becomes shorter toward the −Y-direction side. The second mount surface 45 is slanted, descending in the −C-direction toward the +Y-direction side. In other words, the second mount surface 45 is slanted toward the first mount surface 42.

The second mount surface 44 and the second mount surface 45 are slanted relative to the B-Y plane at almost the same angle. The area and slanting angle of each of the second mount surfaces 44, 45 are set so that the second mount surface 44, 45 can come into contact with the sheet P.

The third mount surfaces 46, 47 are located on outer sides relative to the first mount surface 42 and the second mount surfaces 44, 45 in the Y-direction, respectively.

The third mount surface 46 is a surface that is continuous with the second mount surface 44 and located on the +Y-direction side relative to the second mount surface 44. The third mount surface 46 is formed almost in a rectangular shape, except for the cut-off portion located at the −B-direction side. The third mount surface 46 extends along the Y-direction which is an example of a direction intersecting with the −D-direction (FIG. 5). In other words, the third mount surface 46 is a planar surface extending along the B-Y plane, like the first mount surface 42.

The third mount surface 47 is a surface that is continuous with the second mount surface 45 and located on the −Y-direction side relative to the second mount surface 45. The third mount surface 47 is formed almost in a rectangular shape, except for the cut-off portion located at the −B-direction side. The third mount surface 47 extends along the Y-direction which is an example of a direction intersecting with the +D-direction (FIG. 5). In other words, the third mount surface 47 is a planar surface extending along the B-Y plane, like the first mount surface 42.

The fourth mount surface 48 is a surface that is continuous with the first mount surface 42, the second mount surfaces 44, 45, and the third mount surfaces 46, 47 and is located on the +B-direction side relative to these surfaces. The fourth mount surface 48 is, by way of example, a planar surface extending along the X-Y plane, which is a horizontal plane. At an edge portion in the −B-direction, the fourth mount surface 48 is depressed in the +B-direction at its Y-direction center portion relative to its Y-direction end portions.

Figure 6:
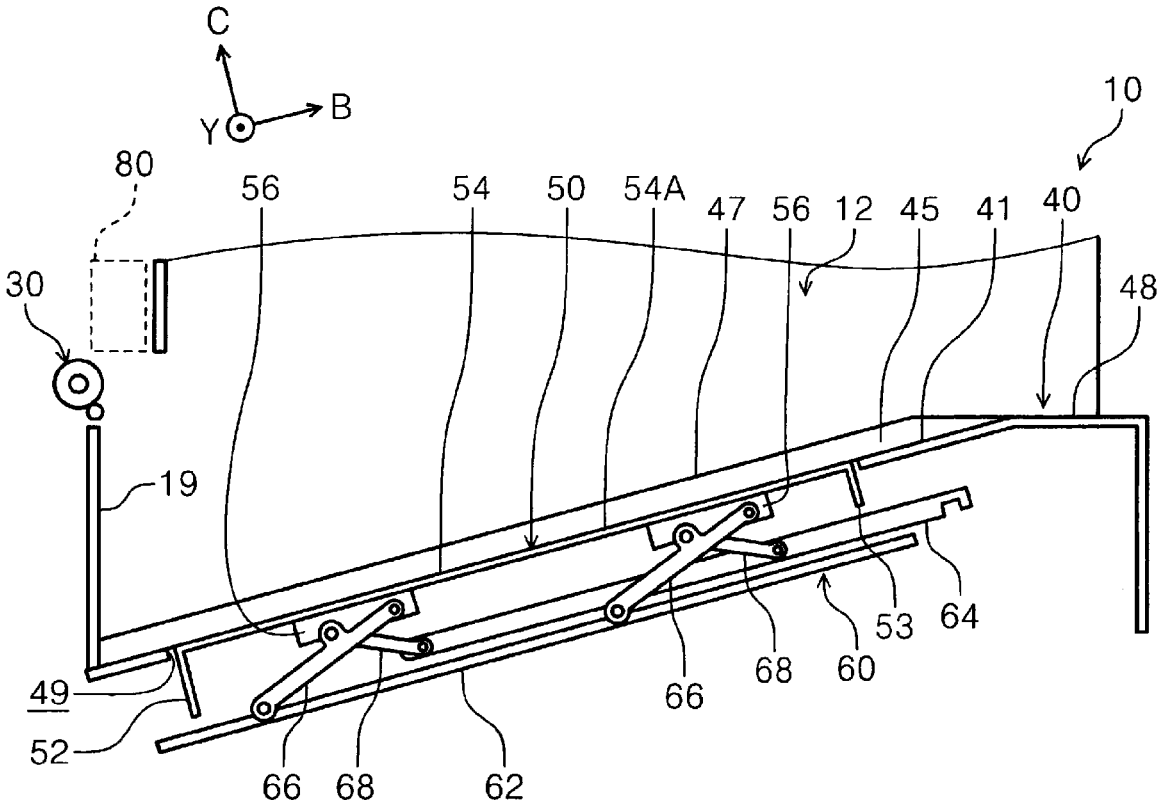
FIG. 6 is a schematic view of the mount section and the discharge section according to Embodiment 1, seen in a width direction.

As illustrated in FIG. 6, the movable rib 50 is an example of a protrusion configured to protrude in the C-direction from the mount surface 41 and is formed in a hollow cuboid shape long in the B-direction. The movable rib 50 is open at its end portion in the −C-direction. The movable rib 50 has side walls 52 forming a frame shape when seen in the C-direction, an upper wall 54 covering the +C-direction edge portions of the side walls 52, and two slide rails 56 provided inside the side walls 52. A notch portion 53 is formed in an edge portion of the side wall 52 located at the +B-direction side.

An upper surface 54A of the upper wall 54 at the +C-direction side is a planar surface extending along the B-Y plane. The upper surface 54A is formed in a rectangular shape whose dimension in the B-direction is longer than its dimension in the Y-direction when seen in the C-direction.

The A-direction dimension of the movable rib 50 is larger than the Y-direction dimension thereof. The B-direction dimension of the movable rib 50 is smaller than the B-direction dimension of the maximum size of the sheet P usable for the printer 10. Also, the Y-direction dimension of the movable rib 50 is smaller than the Y-direction dimension of the minimum size of the sheet P usable for the printer 10.

By being caused to reciprocate in the C-direction by the move section 60 to be described later, the movable rib 50 is movable between a protruding position where the movable rib 50 protrudes in the +C-direction from the mount surface 41 and a retracted position where the upper surface 54A is almost level with the mount surface 41 in the C-direction. The protruding position is an example of a second position, and the retracted position is an example of a first position. The movable rib 50 supports part of the sheet P both at the protruding position and at the retracted position. In the present embodiment, the sheet P is transported using a center registration method. Thus, the movable rib 50 supports substantially the Y-direction center portion of the sheet P.

The move section 60 is configured as, by way of example, a link mechanism section. Specifically, the move section 60 is configured including a support plate 62, a move bar 64, two first link members 66 arranged with an interspace therebetween in the B-direction, and second link members 68 linked to the two respective first link members 66.

The support plate 62 is on the −C-direction side relative to the movable rib 50 and extends in the B-direction.

The move bar 64 is provided between the support plate 62 and the movable rib 50 and is able to reciprocate in the B-direction. A motor (not illustrated) causes the move bar 64 to reciprocate in the B-direction. The position of the move bar 64 in the B-direction is detected by a sensor (not illustrated). A detection result from this sensor is used to detect whether the movable rib 50 is at the protruding position or at the retracted position. The positional information on the movable rib 50 is sent to the control section 70.

Each of the first link members 66 is long in one direction. A first end portion of the first link member 66 is linked to the support plate 62 in such a manner as to be rotatable about an axis extending in the Y-direction. A second end portion of the first link member 66 is linked to the slide rail 56 in such a manner as to be rotatable about an axis extending in the Y-direction and move along the slide rail 56.

Each of the second link members 68 is long in one direction and shorter than the first link member 66. A first end portion of the second link member 68 is linked to part of the first link member 66 in such a manner as to be rotatable about an axis extending in the Y-direction. A second end portion of the second link member 68 is linked to the move bar 64 in such a manner as to be rotatable about an axis extending in the Y-direction.

The move section 60 is configured such that when the move bar 64 moves in the +B-direction, the first end portions of the second link members 68 descend in the −C-direction, so that the second end portions of the first link members 66 descend in the −C-direction and slide in the +B-direction relative to the slide rails 56. The move section 60 moves the movable rib 50 down in the −C-direction in this way.

Also, the move section 60 is configured such that when the move bar 64 moves in the −B-direction, the first end portions of the second link members 68 ascend in the +C-direction, so that the second end portions of the first link members 66 ascend in the +C-direction and slide in the −B-direction relative to the slide rails 56. The move section 60 moves the movable rib 50 in the +C-direction in this way. In other words, the move section 60 causes the movable rib 50 to protrude from the mount surface 41 in the +C-direction.

As illustrated in FIG. 2, the control section 70 includes a central processing unit (CPU) 72 functioning as a computer, a memory 74, a timer 76 capable of measuring a period of time or a time based on each timepoint, and a storage (not illustrated). The control section 70 controls various operations of each section of the printer 10. The control by the control section 70 includes controlling movement of the movable rib 50 made by the move section 60 and controlling the amount of air blown by the air blow section 80. The control section 70 also controls the amount of ink Q ejected from the nozzle section N (FIG. 1) based on the image density of an image to be formed on the sheet P.

The memory 74 stores various kinds of data including a program PR executed by the CPU 72. In other words, the memory 74 is an example of a recording medium storing the computer-readable program PR. Other examples of recording media include a compact disc (CD), a digital versatile disc (DVD), a Blu-ray disc, and a universal serial bus (USB) memory stick. The program PR can be loaded into part of the memory 74.

The program PR is a program for causing the CPU 72 to execute the steps for the printer 10 to be described later.

The memory 74 is an example of a storage section and stores a data table DT (FIG. 7). Details of the data table DT will be given later.

As illustrated in FIG. 1, the air blow section 80 is located inside the apparatus main body 12 on the +Z-direction side relative to the discharge section 30 and the discharge opening 15. The air blow section 80 is configured including, by way of example, two fan units 82 (FIG. 5). The operation of the air blow section 80 is controlled by the control section 70 (FIG. 2). The amount of air blown by the air blow section 80 can be changed between a first air blow amount V1 and a second air blow amount V2 to be described later. The first air blow amount V1 is less than the second air blow amount V2.

As illustrated in FIG. 5, when seen in the X-direction, the two fan units 82 are disposed on the +Z-direction side relative to the mount section 40 and the movable rib 50, with an interspace between the fan units 82 in the Y-direction. One of the fan units 82 is disposed on the +Y-direction side relative to the movable rib 50, and the other one of the fan units 82 is disposed on the −Y-direction side relative to the movable rib 50. The two fan units 82 blow air toward the mount surface 41. By way of example, the two fan units 82 are each arranged to blow air mainly toward the first mount surface 42. In this way, the air blow section 80 blows air against a portion of the mount surface 41 on the +Y-direction side relative to the movable rib 50 and a portion of the mount surface 41 on the −Y-direction side relative to the movable rib 50.

When a sheet P is discharged to the mount section 40, the air blow section 80 exerts an air pressure toward the sheet P by blowing air toward the sheet P.

As illustrated in FIG. 2, the touch panel 36 is coupled to the control section 70. The touch panel 36 is an example of a setting section and a display section, and is configured to be able to set various operation parameters of the printer 10 and display various pieces of information, including the operation parameters. The data table DT to be described later can be displayed on the touch panel 36.

The temperature and humidity sensor 38 is, by way of example, provided at the apparatus main body 12. The temperature and humidity sensor 38 measures the temperature and humidity around the printer 10 to be aware of the environment where the printer 10 is installed. Note that the temperature and humidity sensor 38 does not have to be installed in the printer 10. For example, the printer 10 may receive and use, as data on the temperature and humidity, temperature and humidity data measured by an air conditioner (not illustrated) that conditions the temperature and humidity of the place where the printer 10 is installed. The data on the temperature and humidity measured by the temperature and humidity sensor 38 is sent to the control section 70.

By way of example, the sheet sensor 43 is disposed upstream of the record section 26 on the transport route K1. The sheet sensor 43 includes, by way of example, an emitter and a light receiver (not illustrated). The sheet sensor 43 detects a passage start point and a passage end point of the sheet P by determining whether the light receiver receives light emitted from the emitter. In other words, the sheet sensor 43 can detect the position of the sheet P being transported and the size of the sheet P.

Hereinbelow, a specific description is given about the control performed by the control section 70. Concerning the configuration of the printer 10 already described, FIGS. 1 to 6 are to be referred to, and the numbers of individual drawings are not given below.

Based on information on temperature and humidity measured by the temperature and humidity sensor 38, the control section 70 controls movement of the movable rib 50 made by the move section 60.

The control section 70 causes the movable rib 50 to position at the protruding position in the +C-direction when the temperature is first temperature T1 [° C.] and the humidity is first humidity H1 [%]. The control section 70 causes the movable rib 50 to position at the retracted position at which the movable rib 50 is closer to the mount surface 41 than at the +C-direction protruding position when the temperature is second temperature T2 [° C.] higher than the first temperature T1 and the humidity is second humidity H2 [%] higher than the first humidity H1. The first temperature T1, the second temperature T2, the first humidity H1, and the second humidity H2 are not illustrated in the drawings.

The control section 70 controls movement of the movable rib 50 made by the move section 60 based on the information on temperature and humidity measured by the temperature and humidity sensor 38 and information on the amount of ink ejected by the record section 26. In the present embodiment, by way of example, the amount of ink ejected is translated into the image density of an image to be formed on the sheet P, and the control section 70 controls movement of the movable rib 50 made by the move section 60, based on temperature and humidity information and image density information in the data table DT (FIG. 7) to be described later.

A large amount of ink ejected corresponds to a high image density. A small amount of ink ejected corresponds to a low image density. An image density in the present embodiment means not the optical density of an image recorded on the sheet P, but the ratio of the area of an image to be recorded onto the sheet P to the area of its background, i.e., how dense the image is.

FIG. 7 illustrates an example of the data table DT. When the printer 10 can support two or more sizes of the sheet P, the data table DT is set for each of those sizes. The data table DT is stored in the memory 74 (FIG. 2). FIG. 7 illustrates, by way of example, the data table DT for an A4-size sheet P.

In the data table DT, whether to make the movable rib 50 protrude is set for each combination of an environment condition and an image density condition. The data table DT says "OFF" when the movable rib 50 is to be located at the retracted position and "ON" when the movable rib 50 is to be located at the protruding position.

A reference environment in the data table DT refers to an environment where, by way of example, the temperature is 25° C. and the relative humidity is 50%. The reference environment includes a temperature range from higher than 15° C. to lower than 30° C. and a humidity range of higher than 20% to lower than 70%. A low temperature means 15° C. or lower, and a high temperature means 30° C. or higher. A low humidity means 20% or lower, and a high humidity means 70% or higher.

With regards to the image density, a low density means that the area ratio of an image to its background is lower than 50%. An intermediate density means that the area ratio is 50% or higher and 60% or lower. A high density means that the area ratio is higher than 60%.

For instance, the movable rib 50 is brought to the retracted position in an environment with a high temperature and a high humidity and is brought to the protruding position in an environment with a low temperature and a low humidity.

The control section 70 controls the amount of air blown by the air blow section 80 such that the first air blow amount V1 employed when the movable rib 50 does not protrude from the mount surface 41 is less than the second air blow amount V2 employed when the movable rib 50 protrudes from the mount surface 41.

Next, the operation of the printer 10 of Embodiment 1 is described. For the configuration of the printer 10, FIGS. 1 to 7 are to be referred to, and the numbers of the individual drawings are not given below.

Figure 8:
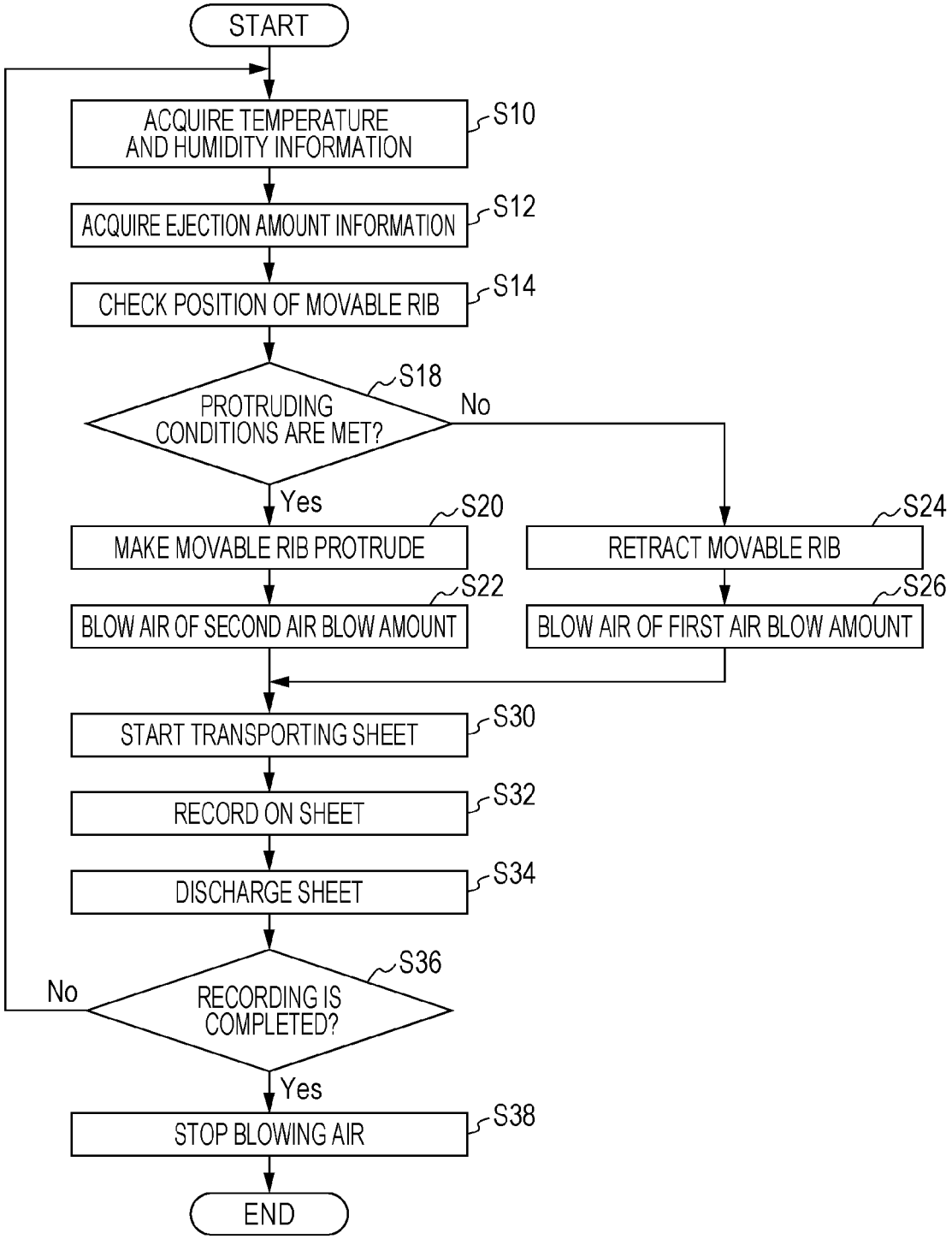
FIG. 8 is a flowchart illustrating the flow of steps of processing executed by the printer according to Embodiment 1.

FIG. 8 is a flowchart illustrating the flow of steps of processing performed by the control section 70 from acquiring temperature and humidity information to stopping air blow. The processing in each step illustrated in FIG. 8 is performed when the CPU 72 reads the program PR from the memory 74, loads the program PR into the memory 74, and executes the program PR.

In Step S10, the CPU 72 acquires temperature and humidity information from the temperature and humidity sensor 38 (an example of a step of acquiring temperature and humidity information). The CPU 72 then proceeds to Step S12.

In Step S12, the CPU 72 acquires information on the amount of ink ejected by the record section 26 based on information on an image to be recorded on the sheet P. Then, by way of example, the CPU 72 converts the information on the amount of ink ejected into information on image density. The CPU 72 then proceeds to Step S14.

In Step S14, the CPU 72 checks the position of the movable rib 50 in the C-direction. Specifically, the CPU 72 uses the sensor of the move section 60 described earlier to check whether the movable rib 50 is at the retracted position or at the protruding position. The CPU 72 then proceeds to Step S18.

In Step S18, the CPU 72 checks the acquired temperature, humidity, and image density information against the data table DT and determines whether the conditions for making the movable rib 50 protrude are met. If the protruding conditions are met (S18: Yes), the CPU 72 proceeds to Step S20. If the protruding conditions are not met (S18: No), the CPU 72 proceeds to Step S24.

In Step S20, the CPU 72 drives the move section 60 to move the movable rib 50 to the protruding position (an example of a step of changing the amount of protrusion of the movable rib 50). If it is determined in Step S14 that the movable rib 50 is already at the protruding position, the CPU 72 does not drive the move section 60 in Step S20. Then, the CPU 72 proceeds to Step S22.

In Step S22, the CPU 72 causes the air blow section 80 to start blowing air of the second air blow amount V2. Then, the CPU 72 proceeds to Step S30.

In Step S24, the CPU 72 drives the move section 60 to move the movable rib 50 to the retracted position (an example of a step of changing the amount of protrusion of the movable rib 50). If it is determined in Step S14 that the movable rib 50 is already at the retracted position, the CPU 72 does not drive the move section 60 in Step S24. The CPU 72 then proceeds to Step S26.

In Step S26, the CPU 72 causes the air blow section 80 to start blowing air of the first air blow amount V1. The first air blow amount V1 is, as mentioned earlier, less than the second air blow amount V2. The CPU 72 then proceeds to Step S30.

In Step S30, the CPU 72 drives the transport section 20 to start transporting the sheet P. Then, the CPU 72 proceeds to Step S32.

In Step S32, the CPU 72 drives the record section 26 to record information on the sheet P. The CPU 72 then proceeds to Step S34.

In Step S34, the CPU 72 drives the discharge section 30 to discharge the sheet P onto the mount section 40. The CPU 72 then proceeds to Step S36.

In Step S36, the CPU 72 determines whether to end the recording on the sheet P based on, e.g., information inputted via the touch panel 36. To end the recording (S36: Yes), the CPU 72 proceeds to Step S38. To record information on another sheet P (S36: No), the CPU 72 proceeds to Step S10. Note that the CPU 72 may proceed to Step S12 to record information on another sheet P.

In Step S38, the CPU 72 causes the air blow section 80 to stop blowing air. The program PR then ends.

Figure 9:
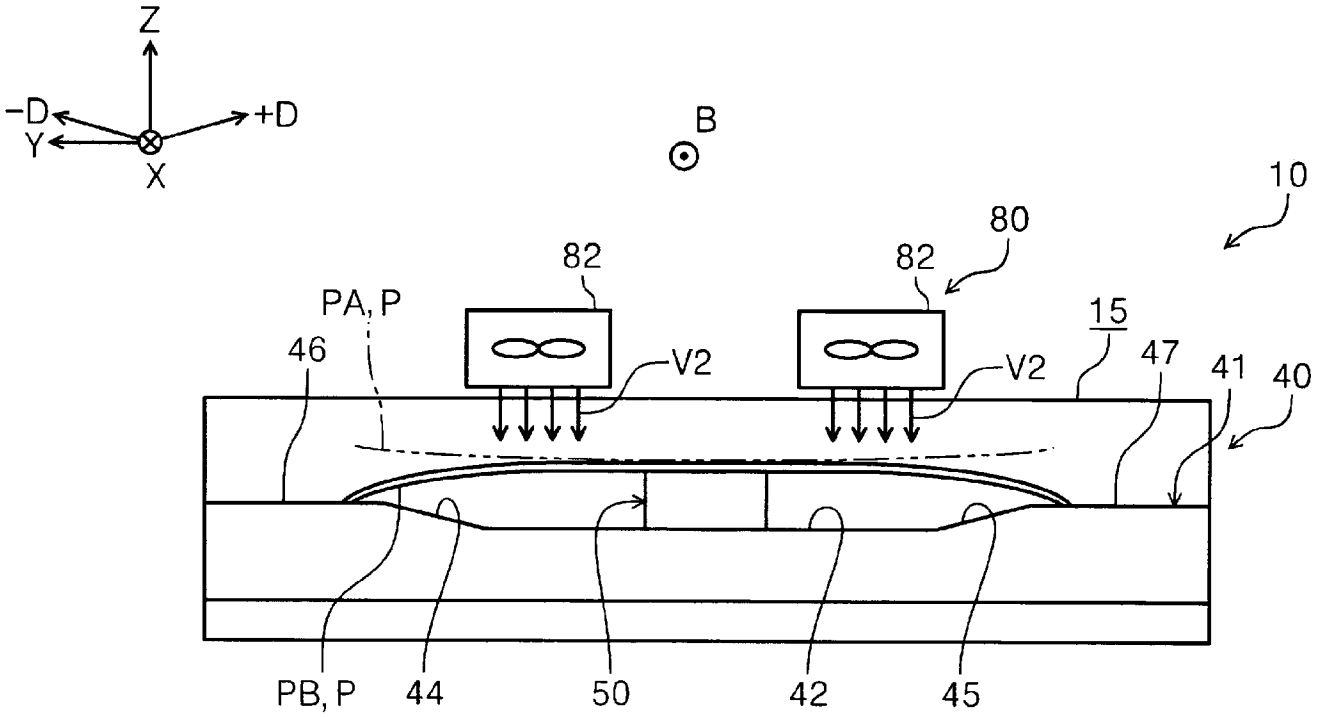
FIG. 9 is a schematic view of the mount section and the air blow section according to Embodiment 1 seen in the discharge direction with the movable rib protruding.

FIG. 9 illustrates a state where the sheet P discharged is in contact with the movable rib 50 which is at the protruding position. The sheet P before coming into contact with the movable rib 50 is illustrated with a dot-dot-dash line PA, and the sheet P after coming into contact with the movable rib 50 is illustrated with a solid line PB. Note that the movable rib 50 is brought to the protruding position when the sheet P has a relatively large curl.

Assume here that, by way of example, the sheet P right after being discharged is curled such that the edge portions in the Y-direction are located more toward the +C-direction than the center portion, as illustrated with the dot-dot-dash line PA. If this sheet P moves toward the mount surface 41, the Y-direction center portion of the sheet P comes into contact with the movable rib 50 before the Y-direction edge portions of the sheet P come into contact with the mount surface 41 because the movable rib 50 is at the protruding position. The Y-direction center portion of the sheet P is thereby supported by the movable rib 50. Then, when seen in the B-direction, the sheet P is forced into a mountain shape having the Y-direction center portion located more toward the +C-direction than the edge portions, as illustrated with the solid line PB. More specifically, the sheet P curled such that the Y-direction edge portions are located upward of the center portion is forced into a state where the Y-direction edge portions of the sheet P are located downward of the center portion thereof, so that the curl of the sheet P can be corrected.

In addition, the amount of air blown by the air blow section 80 is the second air blow amount V2, which is more than the first air blow amount V1. This promotes the forcing of the sheet P to curl.

Figure 10:
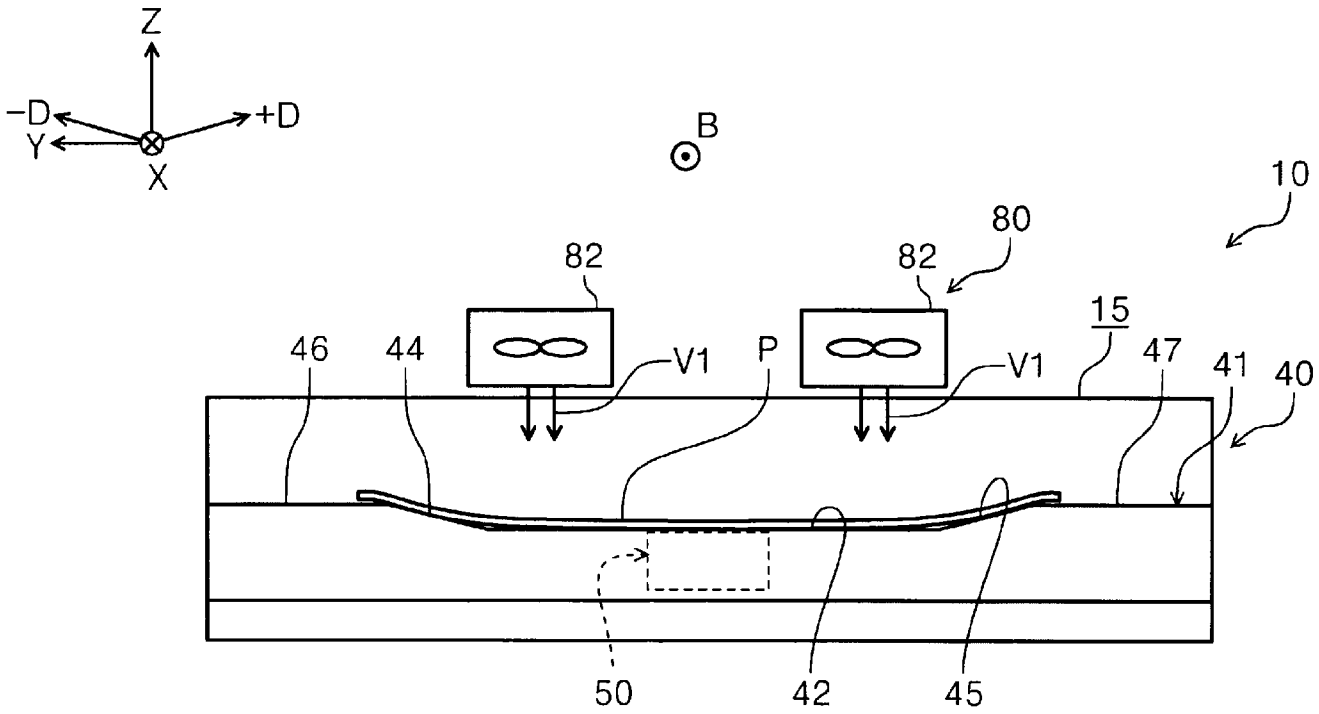
FIG. 10 is a schematic view of the mount section and the air blow section according to Embodiment 1 seen in the discharge direction with the movable rib being retracted.

FIG. 10 illustrates a state where the sheet P discharged is in contact with the mount surface 41 with the movable rib 50 at the retracted position. Note that the movable rib 50 is brought to the retracted position when the sheet P has a relatively small curl.

If the sheet P discharged moves toward the mount surface 41, the Y-direction center portion of the sheet P does not come into contact with the movable rib 50 before the Y-direction edge portions of the sheet P come into contact with the mount surface 41 because the movable rib 50 is at the retracted position. In other words, the sheet P comes into contact with the mount surface 41 and is mounted onto the mount surface 41 without being forced to curl by the movable rib 50. Specifically, the sheet P comes into contact with the first mount surface 42 and the second mount surfaces 44, 45.

The sheet P is thereby formed into a valley shape having the Y-direction center portion located more toward the −C-direction than the edge portions when seen in the B-direction. When the valley-shaped sheet P is in contact with the second mount surfaces 44, 45 which are slanted surfaces, displacement of the sheet P in the Y-direction can be restricted. Further, when the next sheet P is discharged, that next sheet P will be mounted on top of the valley-shaped sheet P and thus restricted from being displaced in the Y-direction as well. In other words, the alignment of a plurality of sheets P can be improved.

Also, the amount of air blown by the air blow section 80 is the first air blow amount V1, which means a small amount of air blow. This helps prevent the sheet P from being displaced in the B-direction or the Y-direction by the air blown by the air blow section 80.

As described thus far, according to the printer 10, when the sheet P is likely to have a curl determining from the temperature and humidity conditions, the control section 70 causes the move section 60 to move to make the movable rib 50 protrude from the mount surface 41 in the +C-direction. The movable rib 50 thus protruding supports the sheet P discharged from the discharge section 30. As a result, portions of the sheet P that are not supported by the movable rib 50 descend toward the mount surface 41 due to their self-weight, so that the sheet P is forced to curl in the opposite direction from the direction in which the sheet P originally curls. The curl of the sheet P can thus be mitigated.

When the sheet P is unlikely to have a curl determining from the temperature and humidity conditions, the control section 70 causes or does not cause the move section 60 to move to make the movable rib 50 not protrude from the mount surface 41 in the +C-direction. In this state, the mount section 40 supports one edge portion and the other edge portion, in the Y-direction, of the sheet P discharged from the discharge section 30. This helps prevent the sheet P that is not curled so much from being displaced in one direction or the other direction in the Y-direction by coming into contact with the movable rib 50. Thus, the alignment of the sheets P can be improved.

The second temperature T2 is higher than the first temperature T1, and the second humidity H2 is higher than the first humidity H1. When the temperature and humidity in the installation environment are high, the amount of moisture penetrating into the sheet P increases, which makes the sheet P unlikely to curl.

According to the printer 10, at the second temperature T2 and the second humidity H2 at which the sheet P is unlikely to curl, the movable rib 50 is brought to the retracted position. In other words, the height of the movable rib 50 is low. As a result, a situation is prevented where the movable rib 50 wastefully protrudes and comes into contact with the sheet P when the sheet P is unlikely to curl. This helps prevent the sheet P from being misaligned in the Y-direction by coming into contact with the movable rib 50.

When the amount of ink ejected increases, more moisture penetrates into the sheet P, which makes the sheet P unlikely to curl. Conversely, when the amount of ink ejected decreases, the sheet P is likely to curl due to the difference in the moisture amount between a portion where the ink Q is attached and a portion where the ink Q is not attached.

According to the printer 10, the amount of protrusion of the movable rib 50 is set based not only on the temperature and humidity information, but also on information on the amount of ink ejected. Thus, the amount of protrusion of the movable rib 50 can be determined accurately depending on whether the sheet P is likely to curl. This accordingly mitigates the curl of the sheet P.

According to the printer 10, a valley shape is formed by the first mount surface 42 and the second mount surfaces 44, 45 when seen in the A-direction. Then, when the movable rib 50 does not protrude, the sheet P is mounted in conformity with the shape formed by the first mount surface 42 and the second mount surfaces 44, 45 by its self-weight. When the mounted sheet P tries to be displaced in the Y-direction, the valley shape restricts the sheet P from being displaced in the Y-direction. This helps prevent misalignment of the mounted sheet P.

Also, according to the printer 10, when the mounted sheet P seems to be displaced in the Y-direction relative to the first mount surface 42 and the second mount surfaces 44, 45 with the movable rib 50 not protruding, the sheet P comes into contact with the third mount surfaces 46, 47, and consequently a friction force is exerted to the sheet P. This helps prevent displacement of the sheet P in the Y-direction.

According to the printer 10, irrespective of whether the movable rib 50 protrudes, not only the self-weight but also the air pressure from the air blow section 80 acts on the sheet P in contact with the movable rib 50. This makes it easier to mitigate a curl in the sheet P.

Also, according to the printer 10, when the movable rib 50 does not protrude from the mount surface 41, the first air blow amount V1 which is less than the second air blow amount V2 is employed. Thus, the air pressure to act on the sheet P decreases. As a result, when the sheet P moves from the discharge section 30 to the mount surface 41, less load is applied to the sheet P, which can help prevent the air blown from the air blow section 80 from restricting the movement of the sheet P.

A method for controlling the printer 10 and a program for controlling the printer 10 can offer operations and advantageous effects similar to those offered by the printer 10.

Embodiment 2

Next, a specific description is given about the configuration of Embodiment 2 as an example of a recording apparatus, an example of a method for controlling the recording apparatus, and an example of a non-transitory computer-readable storage medium storing a program for controlling the recording apparatus according to the present disclosure. Note that sections and methods that are the same as those in Embodiment 1 are denoted by the same reference numerals as those used in Embodiment 1 and are not described again below.

Figure 11:
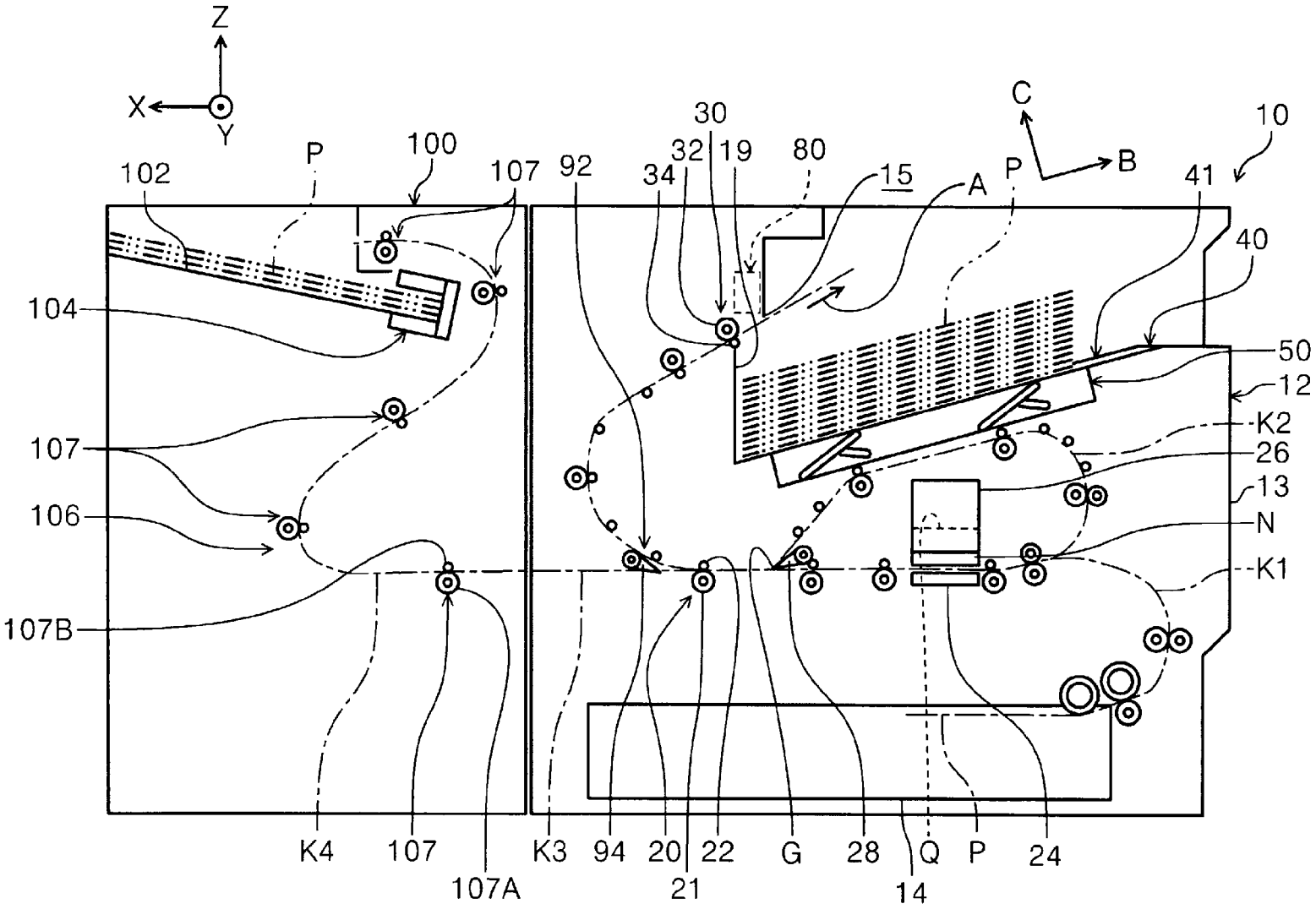
FIG. 11 is an overall view of a printer and a post-processing apparatus according to Embodiment 2.

As illustrated in FIG. 11, the printer 10 of Embodiment 2 additionally has a switch section 92 and a transport route K3 branching from the transport route K1 at a position on the +X-direction side relative to the position G. Also, a post-processing apparatus 100 is disposed on the +X-direction side relative to the printer 10.

The transport route K1 which is downstream of the position G is an example of a first route directed toward the discharge section 30.

The transport route K3 is an example of a second route directed toward the post-processing apparatus 100. The transport route K3 extends in, by way of example, the +X-direction. A through-hole (not illustrated) is formed in the housing 13 at a portion overlapping with the transport route K3.

The switch section 92 switches the transport route of the sheet P having information recorded thereon by the record section 26 to either the transport route K1 or the transport route K3. Specifically, the switch section 92 has a flapper 94 as well as a motor and gears (not illustrated) for rotating the flapper 94.

Figure 12:
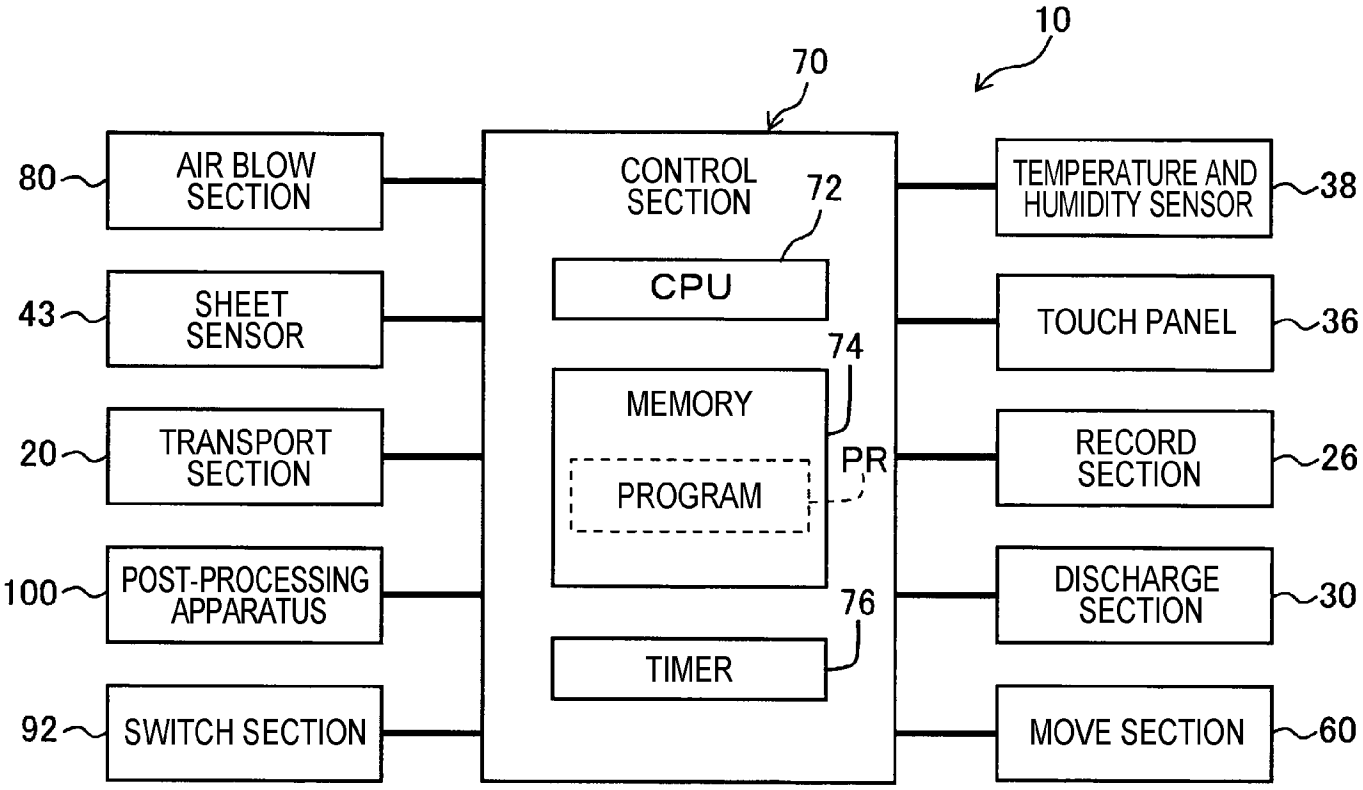
FIG. 12 is a block diagram of a main part of the printer and the post-processing apparatus according to Embodiment 2.

The flapper 94 is disposed in the vicinity of a branch point between the transport route K1 and the transport route K3. The flapper 94 is switchable between a position to permit the sheet P to move to the transport route K1 and restrict the sheet P from entering the transport route K3 and a position to guide the sheet P from the transport route K1 to the transport route K3. The flapper 94 is switched by the control section 70 (FIG. 12).

The post-processing apparatus 100 is an example of a post-processing section, and is configured including a sheet stacker 102 on which a plurality of sheets P are stacked, a stapler 104 provided at the sheet stacker 102, and a rear transport section 106 that transports the sheet P sent in from the transport route K3 toward the sheet stacker 102. The post-processing apparatus 100 subjects the sheets P having information recorded thereon by the record section 26 to stapling processing performed by the stapler 104 as an example of post-processing after recording.

The rear transport section 106 transports the sheet P along a transport route K4 formed inside the post-processing apparatus 100. The rear transport section 106 has a plurality of roller pairs 107. Each roller pair 107 includes a drive roller 107A and a driven roller 107B.

The stapler 104 staples a plurality of sheets P stacked on the sheet stacker 102 as the stapling processing.

As illustrated in FIGS. 11 and 12, the printer 10 of Embodiment 2 additionally has the switch section 92 and the post-processing apparatus 100.

The control section 70 controls the switching operation of the switch section 92 based on the information on the temperature and humidity measured by the temperature and humidity sensor 38. By way of example, at least one of the above-described hot and humid environment condition and the above-described high density condition is met, the control section 70 controls the switching of the switch section 92 so that the sheet P may be transported to the post-processing apparatus 100. Note that it is assumed here, by way of example, that the stapling processing by the post-processing apparatus 100 is not selected.

Conversely, in a case of an environment other than the hot and humid environment and an image density other than the high density, the control section 70 controls the switching of the switch section 92 so that the sheet P may be transported to the mount section 40. Meanwhile, the position of the movable rib 50 is switched based on the data table DT (FIG. 7).

Also, when part of the transport route of the sheet P in the printer 10 is the transport route K3, the control section 70 controls the move section 60 so that the movable rib 50 may not protrude from the mount surface 41, irrespective of the temperature and humidity information from the temperature and humidity sensor 38. In other words, the control section 70 causes the movable rib 50 to position at the retracted position when the sheet P is transported to the post-processing apparatus 100.

Next, the operation of the printer 10 of Embodiment 2 is described. For the sections constituting the printer 10, the description of Embodiment 1 is to be referred to, and the numbers of individual drawings and specific descriptions are not given below.

Figure 13:
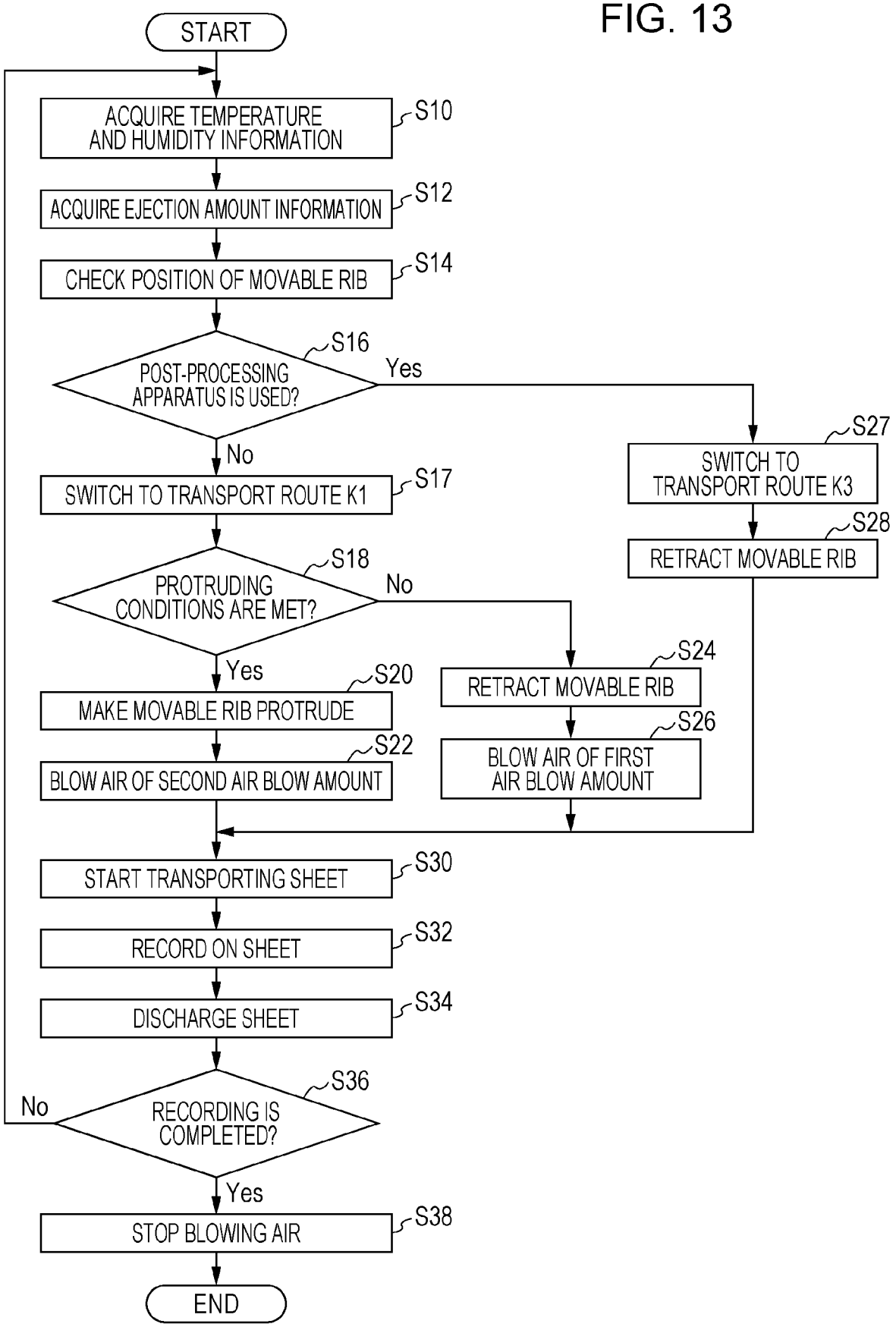
FIG. 13 is a flowchart illustrating the flow of steps of processing executed by the printer according to Embodiment 2.

FIG. 13 is a flowchart illustrating the flow of the steps of processing performed by the control section 70 from acquiring temperature and humidity information to stopping air blown by the air blow section 80. The processing in each step illustrated in FIG. 13 is performed when the CPU 72 reads the program PR from the memory 74, loads the program PR into the memory 74, and executes the program PR. The same steps as those in Embodiment 1 are denoted by the same reference numerals as those used in Embodiment 1 and are not described below.

After performing Steps S10 to S14, the CPU 72 proceeds to Step S16.

In Step S16, based on the above-described pieces of information, the CPU 72 determines whether to use the post-processing apparatus 100. When determining not to use the post-processing apparatus 100 (S16: No), the CPU 72 proceeds to Step S17. When determining to use the post-processing apparatus 100 (S16: Yes), the CPU 72 proceeds to Step S27.

In Step S17, the CPU 72 switches the switch section 92 so that the sheet P may take the transport route K1. If the transport route is already set to the transport route K1, the switch section 92 is left as is. The CPU 72 then proceeds to Step S18 and executes Step S18 and subsequent steps.

In Step S27, the CPU 72 switches the switch section 92 so that the sheet P may take the transport route K3. If the transport route is already set to the transport route K3, the switch section 92 is left as is. The CPU 72 then proceeds to Step S28.

In Step S28, the CPU 72 causes the movable rib 50 to position at the retracted position. The CPU 72 then proceeds to Step S30 and executes Step S30 and subsequent steps.

According to the printer 10 of Embodiment 2, the transport route K3 that the sheet P having information recorded thereon takes to be subjected to the post-processing by the post-processing apparatus 100 is longer than the transport route K1 that the sheet P having information recorded thereon takes to be discharged from the discharge section 30. Thus, the transport route of the sheet P can be set longer. When the transport route K3 is selected, the sheet P is more likely to dry, and therefore a curl of the sheet P can be further mitigated. Also, when the transport route of the sheet P is the transport route K3, the movable rib 50 does not protrude from the mount surface 41. This helps prevent the movable rib 50 from making it hard to take out the sheet P mounted on the mount surface 41.

Embodiment 3

Next, a specific description is given about the configuration of Embodiment 3 as an example of a recording apparatus, an example of a method for controlling the recording apparatus, and an example of a non-transitory computer-readable storage medium storing a program for controlling the recording apparatus according to the present disclosure. Note that sections and methods that are the same as those of Embodiments 1 and 2 are denoted by the same reference numerals as those used in Embodiments 1 and 2 and are not described again below.

Figure 14:
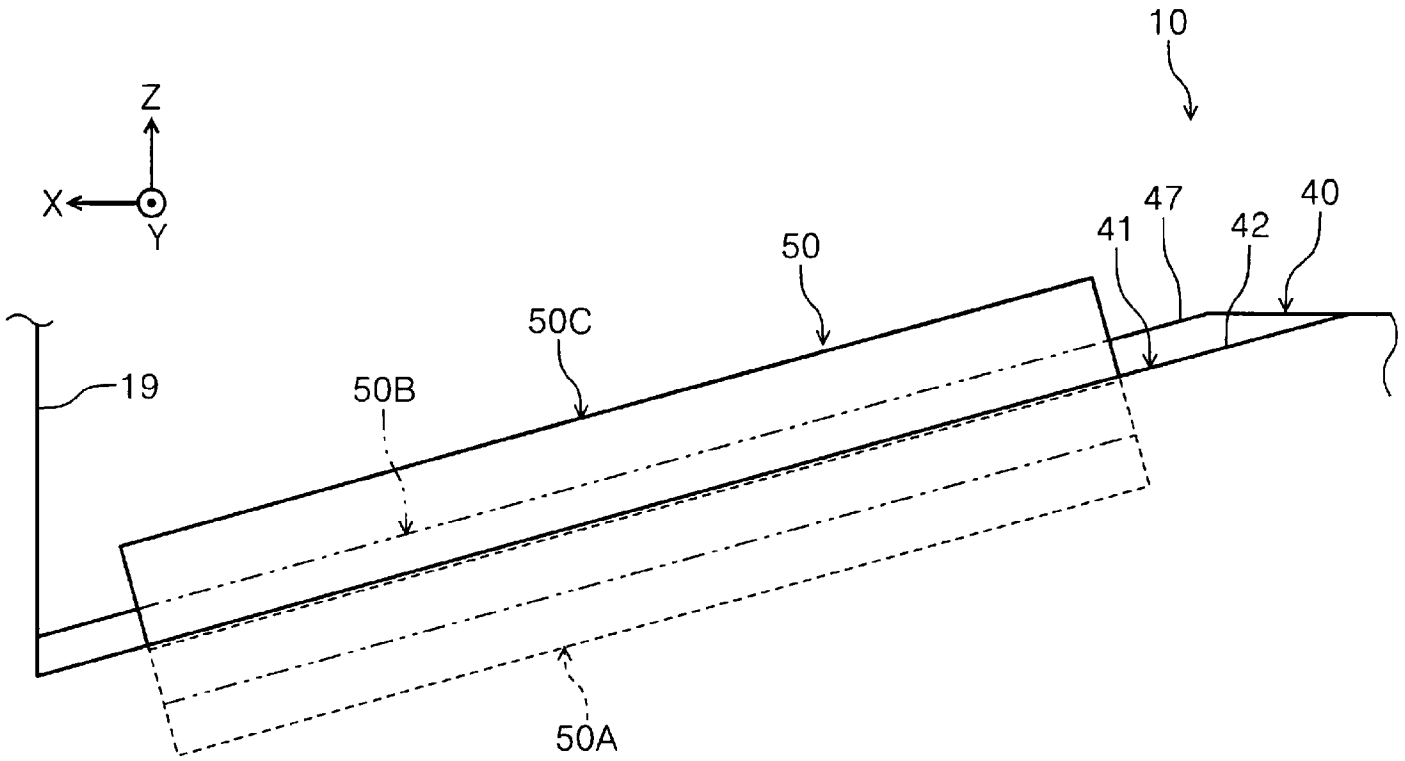
FIG. 14 is a schematic view of how a movable rib according to Embodiment 3 is moved in three stages.

As illustrated in FIG. 14, the printer 10 of Embodiment 3 differs from the printer 10 of Embodiment 1 in that the amount of protrusion of the movable rib 50 from the mount surface 41 in the C-direction can be changed in three stages. Other configurations are the same as those in Embodiment 1.

By way of example, the movable rib 50 can stop also at an intermediate position between the retracted position and the protruding position in the C-direction. The intermediate position is set at, by way of example, the center between the retracted position and the protruding position in the C-direction.

The movable rib 50 at the retracted position is illustrated with a broken line 50A as a movable rib 50A. The movable rib 50 at the intermediate position is illustrated with a dot-dot-dash line 50B as a movable rib 50B. The movable rib 50 at the protruding position is illustrated with a solid line 50C as a movable rib 50C.

In the data table DT (FIG. 7) described earlier, "ON" is replaced by either "FIRST MOVE AMOUNT" or "SECOND MOVE AMOUNT." The first move amount is the maximum move amount of the movable rib 50 in the C-direction. The second move amount is half the first movement amount.

Regarding the position of the movable rib 50, the intermediate position may be selected not only by the control section 70 but also by an operator using the touch panel 36 (FIG. 2). The control section 70 selects the intermediate position when, for example, it is preferable to correct a curl in the sheet P but it is also desirable to increase the number of sheets P mounted or when it is preferable to correct a curl in the sheet P but it is also desirable to ensure the alignment of the sheet P. In either case, the position of the movable rib 50 is set in advance for each combination of an environmental condition based on temperature and humidity and a use condition based on an image density or the amount of ink ejected.

Next, the operation of the printer 10 of Embodiment 3 is described. For the sections constituting the printer 10, the description of Embodiment 1 is to be referred to, and the numbers of individual drawings and specific descriptions are not given below.

According to the printer 10 of Embodiment 3, the height of the movable rib 50 can be changed in three or more multiple stages depending on the status of curl formed in the sheet P. This helps prevent the movable rib 50 from protruding from the mount surface 41 excessively and also allows more sheets P to be stacked.

The printers 10 according to Embodiment 1, Embodiment 2, and Embodiment 3 of the present disclosure are basically configured as described above. However, it goes without saying that the configuration of the printer 10 may be partially changed or omitted without departing from the gist of the disclosure of the present application.

Also, the data table DT set in the printer 10 may be based only on temperature information or only on humidity information, and the movement of the movable rib 50 by the move section 60 may be controlled based on such a data table. Also, the temperature and humidity information is not limited to information measured by the temperature and humidity sensor 38, but also, for example, information acquired from a different measuring apparatus connected to the printer 10 via a network.

Even after the temperature and humidity increase from the first temperature T1 and the first humidity H1 to the second temperature T2 and the second humidity H2, the movable rib 50 may be kept at the protruding position if the sheet P may curl.

In the printer 10, movement of the movable rib 50 may be controlled based only on temperature and humidity information, not on the amount of ink ejected.

The mount surface 41 may be without any of the second mount surfaces 44, 45, the third mount surfaces 46, 47, and the fourth mount surface 48. Also, the mount surface 41 may be formed by a single surface.

The third mount surfaces 46, 47 may each be a surface extending in a direction intersecting with the first mount surface 42.

In the printer 10, the air blow section 80 is not limited to having two fan units 82, and may be configured to blow air using, for example, one fan and a branching duct. Also, the air blow section 80 can blow air toward the movable rib 50 from a single fan.

The first air blow amount V1 employed by the control section 70 when the movable rib 50 does not protrude from the mount surface 41 may be nearly equal to the second air blow amount V2 employed when the movable rib 50 protrudes from the mount surface 41.

The number of stages in which the protrusion amount of the movable rib 50 is changed in the C-direction is not limited to two like in Embodiments 1 and 2 or three like in Embodiment 3, but may be four or more. Also, more than one movable rib 50 may be provided. For example, a plurality of movable ribs 50 may be arranged in the Y-direction.

The border-line value between low temperature and high temperature, the border-line value of low humidity and high humidity, and border-line values between the low, medium, and high image densities are not limited to and may be different from the values given in Embodiment 1. Also, the position of the movable rib 50 may be determined with the size of the sheet P additionally included as one of the condition parameters.

The upper surface 54A of the movable rib 50 may be a surface extending along the horizontal plane.

The configuration of the move section 60 is not limited to one having a link mechanism, but may be a configuration using a wire or a rack and pinion.

The medium is not limited to the sheet P, but may be a film or a thick sheet material.

Each of the second mount surfaces 44, 45 is not limited to having the same Y-direction width in the B-direction when seen in the C-direction, but may have different Y-direction widths in the B-direction. Also, each of the slanting angles of the second mount surfaces 44, 45 may be different in the B-direction. For example, the slanting angles of the second mount surfaces 44, 45 relative to the B-Y plane may be larger at a portion close to the discharge opening 15 and smaller at a portion away from the discharge opening 15.

The post-processing apparatus 100 is not limited to one that performs stapling processing, but may be one that performs punching to form punch holes in a plurality of sheets P or one that performs saddle stitch binding.

The record section is not limited to the record section 26, but may be a serial-type head that is mounted in a carriage and configured to eject the ink Q to the sheet P while moving in the Y-direction.

What is claimed is:

1. A recording apparatus comprising:

a record section that records on a medium by ejecting a liquid to the medium;

a discharge section that discharges the medium recorded by the record section;

a mount section that has a mount surface on which the medium discharged by the discharge section is mounted;

a protrusion that is configured to support the medium and protrude from the mount surface in a stacking direction in which the medium is stacked, a first dimension of the protrusion in a discharge direction in which the medium is discharged being larger than a second dimension of the protrusion in a width direction intersecting with the discharge direction;

a move section that moves the protrusion in the stacking direction; and a control section that controls, based on at least one of information on temperature and information on humidity, movement of the protrusion made by the move section.

2. The recording apparatus according to claim 1, wherein when the temperature is a first temperature and the humidity is a first humidity, the control section causes the protrusion to position at a first position in the stacking direction, and when the temperature is a second temperature that is higher than the first temperature and the humidity is a second humidity that is higher than the first humidity, the control section causes the protrusion to position at a second position at which the protrusion is closer to the mount surface than at the first position in the stacking direction.

3. The recording apparatus according to claim 1, wherein an amount of liquid ejected from the record section is configured to be changed, and the control section controls, based on the information on the temperature, the information on the humidity, and information on the amount of liquid ejected, movement of the protrusion made by the move section.

4. The recording apparatus according to claim 1, wherein the mount surface has a first mount surface that has an opening through which the protrusion is configured to pass and second mount surfaces that locate on one side and an opposite side relative to the first mount surface in the width direction and slant toward the first mount surface.

5. The recording apparatus according to claim 4, wherein the mount surface further has third mount surfaces that locates on outer sides in the width direction relative to the first mount surface and the second mount surfaces, and the third mount surfaces extend along directions intersecting with directions in which the second mount surfaces are slanted.

6. The recording apparatus according to claim 1, further comprising;

an air blow section that blows air against one portion of the mount surface and an opposite portion of the mount surface relative to the protrusion in the width direction.

7. The recording apparatus according to claim 6, wherein the control section is configured to change an air blow amount of the air blow section based on a position of the protrusion.

8. The recording apparatus according to claim 6, wherein when the protrusion does not protrude from the mount surface, the control section employs a first air blow amount for the air blow section and when the protrusion protrudes from the mount surface, the control section employs a second air blow amount for the air blow section, the first air blow amount being less than the second air blow amount.

9. The recording apparatus according to claim 1, wherein an amount of protrusion of the protrusion from the mount surface is configured to be changed in a plurality of stages.

10. The recording apparatus according to claim 1, further comprising:

a post-processing section that performs a post-processing on the medium recorded by the record section; and a switch section that switches a transport route of the medium recorded by the record section to one of a first route directed to the discharge section and a second route directed to the post-processing section, wherein the control section controls, based on at least one of the information on the temperature and the information on the humidity, switching operation of the switch section, and when the transport route of the medium is the second route, the control section controls the move section so that the protrusion does not protrude from the mount surface.

11. A method for controlling a recording apparatus including a record section that records on a medium by ejecting a liquid to the medium, a discharge section that discharges the medium recorded by the record section, a mount section that has a mount surface on which the medium discharged by the discharge section is mounted, a protrusion that is configured to support the medium and protrude from the mount surface in a stacking direction in which the medium is stacked, a first dimension of the protrusion in a discharge direction in which the medium is discharged being larger than a second dimension of the protrusion in a width direction intersecting with the discharge direction, a move section that moves the protrusion in the stacking direction, and a control section that controls movement of the protrusion made by the move section, the method comprising:

acquiring at least one of information on temperature and information on humidity; and changing, based on at least one of the information on the temperature and the information on the humidity, an amount of protrusion of the protrusion from the mount surface.

12. A non-transitory computer-readable storage medium storing a program for controlling a recording apparatus including a record section that records on a medium by ejecting a liquid to the medium, a discharge section that discharges the medium recorded by the record section, a mount section that has a mount surface on which the medium discharged by the discharge section is mounted, a protrusion that is configured to support the medium and protrude from the mount surface in a stacking direction in which the medium is stacked, a first dimension of the protrusion in a discharge direction in which the medium is discharged being larger than a second dimension of the protrusion in a width direction intersecting with the discharge direction, a move section that moves the protrusion in the stacking direction, and a control section that controls movement of the protrusion made by the move section, the program causing a computer to execute:

acquiring at least one of information on temperature and information on humidity; and changing, based on at least one of the information on the temperature and the information on the humidity, an amount of protrusion of the protrusion from the mount surface.

* * * * *